US011631372B2

(12) United States Patent
Yamamoto et al.

(10) Patent No.: US 11,631,372 B2
(45) Date of Patent: Apr. 18, 2023

(54) PIXEL CIRCUIT DRIVING METHOD, PIXEL CIRCUIT, AND DISPLAY DEVICE

(71) Applicant: JOLED INC., Tokyo (JP)

(72) Inventors: Tetsuro Yamamoto, Tokyo (JP); Kenji Kokuda, Tokyo (JP); Hitoshi Tsuge, Tokyo (JP); Teppei Tanaka, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/495,251

(22) Filed: Oct. 6, 2021

(65) Prior Publication Data

US 2022/0114961 A1 Apr. 14, 2022

(30) Foreign Application Priority Data

Oct. 13, 2020 (JP) ..... JP2020-172823

(51) Int. Cl.
*G09G 3/3233* (2016.01)

(52) U.S. Cl.
CPC ... *G09G 3/3233* (2013.01); *G09G 2300/0426* (2013.01); *G09G 2300/0842* (2013.01); *G09G 2310/08* (2013.01); *G09G 2330/021* (2013.01)

(58) Field of Classification Search
CPC ..... G09G 3/3233; G09G 2300/0426; G09G 2300/0842; G09G 2310/08; G09G 2330/021
See application file for complete search history.

(56) References Cited

U.S. PATENT DOCUMENTS

2006/0125740 A1* 6/2006 Shirasaki ..... G09G 3/325 345/77
2008/0231625 A1* 9/2008 Minami ..... G09G 3/3233 345/212
2016/0210898 A1* 7/2016 Tsuge ..... G09G 3/3233

FOREIGN PATENT DOCUMENTS

JP 2013-057947 3/2013

* cited by examiner

*Primary Examiner* — Stephen G Sherman

(74) *Attorney, Agent, or Firm* — Greenblum & Bernstein, P.L.C.

(57) ABSTRACT

A pixel circuit driving method is a method for driving a pixel circuit that includes a drive transistor that supplies a current corresponding to a signal voltage supplied via a signal line, a write transistor connected between the signal line and a gate electrode of the drive transistor, and an organic EL element that emits light in accordance with the current. The pixel circuit driving method includes supplying a reference potential to the gate electrode of the drive transistor before a threshold correction preparation operation of making a gate-source voltage of the drive transistor higher than a threshold voltage of the drive transistor.

15 Claims, 20 Drawing Sheets

PIXEL CIRCUIT DRIVING METHOD, PIXEL CIRCUIT, AND DISPLAY DEVICE

CROSS REFERENCE TO RELATED APPLICATION

The present application is based on and claims priority of Japanese Patent Application No. 2020-172823 filed on Oct. 13, 2020. The entire disclosure of the above-identified application, including the specification, drawings and claims is incorporated herein by reference in its entirety.

FIELD

The present disclosure relates to a method for driving a pixel circuit that includes a light-emitting element such as an organic electroluminescent (EL) element, the pixel circuit, and a display device.

BACKGROUND

The organic EL element is a known electrooptic element used for a self-emitting display device. The organic EL element is an electrooptic element that uses the phenomenon in which an organic thin film emits light when an electric field is applied thereto, and the tone of the color of the emitted light is controlled by controlling the value of the current flowing through the organic EL element. To this end, an organic EL display device using the organic EL elements includes a pixel circuit provided for each pixel, the pixel circuit including a driving transistor for controlling the amount of the current of the organic EL elements and a holding capacitor (capacitor) for holding the control voltage for the driving transistor.

Variations in characteristics of the driving transistor may affect the luminance of the light emitted by the organic EL element. The variations in characteristics of the driving transistor are variations of the threshold voltage or variations of the mobility, for example. In this respect, PTL 1 discloses a display device that performs a threshold voltage correction for compensating for variations of the threshold voltage of the driving transistor and a mobility correction for compensating for variations of the mobility of the driving transistor.

CITATION LIST

Patent Literature

PTL 1: Japanese Unexamined Patent Application Publication No. 2013-057947

SUMMARY

Technical Problem

With a display device including a pixel circuit such as that described above, it is desired to improve the display quality of the displayed video.

To this end, the present disclosure provides a method for driving a pixel circuit, a pixel circuit, and a display device that improve display quality.

Solution to Problem

A pixel circuit driving method according to an aspect of the present disclosure is a method for driving a pixel circuit including a drive transistor that supplies a current corresponding to a signal voltage supplied via a signal line, a write transistor connected between the signal line and a gate electrode of the drive transistor, and a light-emitting element that emits light in accordance with the current, the method including: supplying a predetermined voltage to the gate electrode of the drive transistor before a threshold correction preparation operation of making a gate-source voltage of the drive transistor higher than a threshold voltage of the drive transistor.

A pixel circuit according to an aspect of the present disclosure includes: a drive transistor that supplies a current corresponding to a signal voltage supplied via a signal line; a write transistor connected between the signal line and a gate electrode of the drive transistor; and a light-emitting element connected to one of a source electrode and a drain electrode of the drive transistor, wherein a predetermined voltage is applied to the gate electrode of the drive transistor before a threshold correction preparation operation of making a gate-source voltage of the drive transistor higher than a threshold voltage of the drive transistor.

A display device according to an aspect of the present disclosure includes: the above-described pixel circuit; a horizontal selector that supplies a signal voltage to the signal line; and a controller that performs control for supplying the predetermined voltage to the gate electrode of the drive transistor, wherein the controller applies the predetermined voltage to the gate electrode of the drive transistor before the threshold correction preparation operation.

Advantageous Effects

According to the method for driving a pixel circuit, and so on, according to an aspect of the present disclosure, the quality of a displayed video can be improved.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENT (Underlying Knowledge Forming Basis of Present Disclosure)

Before describing an embodiment of the present disclosure and variations thereof, underlying knowledge forming the basis of the present disclosure will be described.

Figure 1:
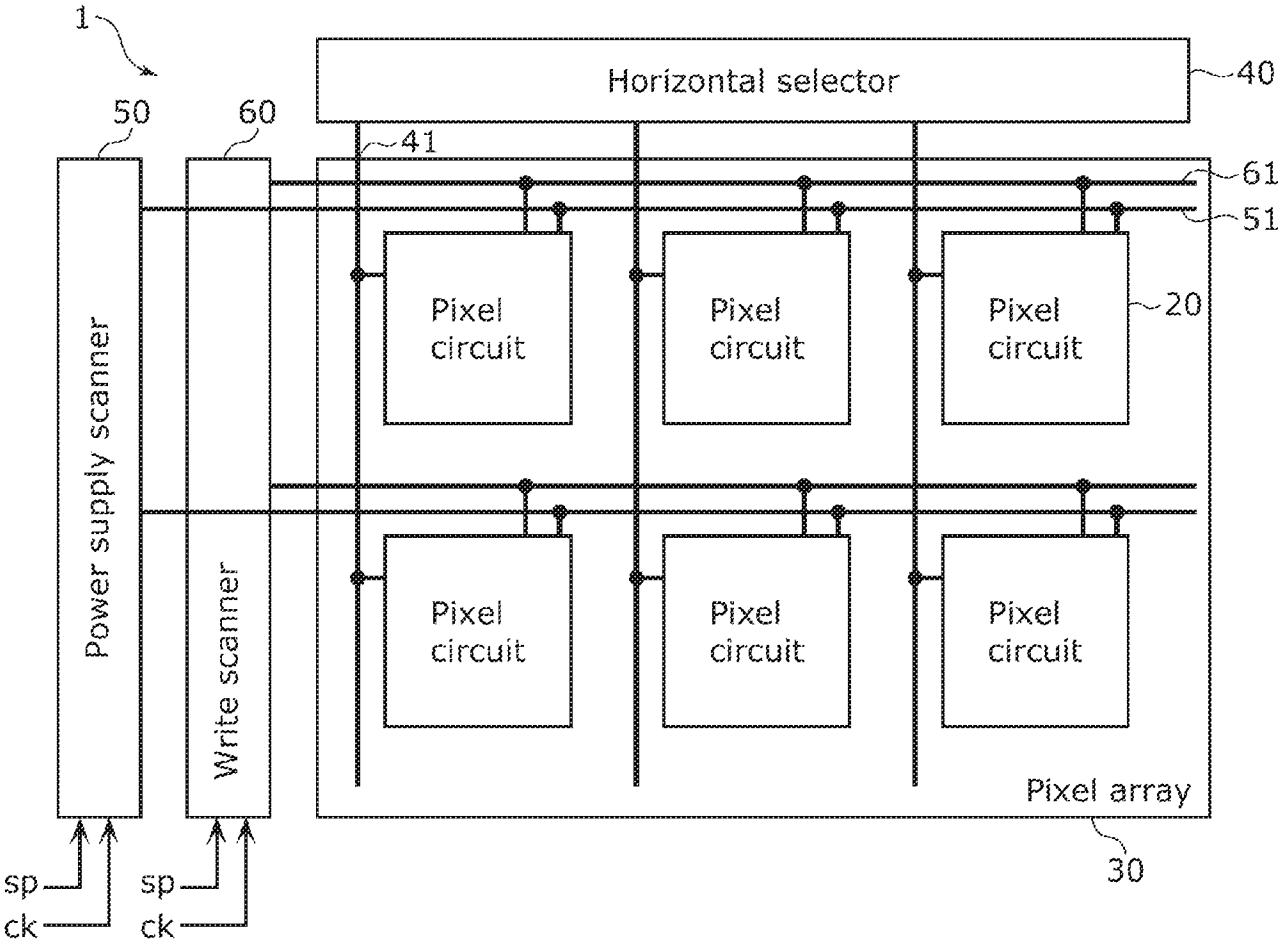
FIG. 1 PRIOR ART
FIG. 1 is a diagram illustrating an outline configuration of an organic EL display device according to a related art.

First, an outline configuration of an organic EL display device according to the related art will be described with reference to FIG. 1. FIG. 1 is a diagram illustrating an outline configuration of organic EL display device 1 according to the related art.

As illustrated in FIG. 1, organic EL display device 1 that is a basis for the present disclosure includes pixel array 30 formed by a plurality of pixel circuits 20 including an organic EL element that are two-dimensionally arranged in a matrix, horizontal selector 40, power supply scanner 50, and write scanner 60. Horizontal selector 40, power supply scanner 50, and write scanner 60 form a driving circuit (driver) arranged in the periphery of pixel array 30.

When organic EL display device 1 is capable of color display, a single pixel (unit pixel/pixel), which is a unit forming a color image, is formed by a plurality of sub-pixel circuits, and each sub-pixel circuit corresponds to pixel circuit 20 in FIG. 1. More specifically, with organic EL display device 1 capable of color display, a single pixel is formed by three sub-pixel circuits, a first sub-pixel circuit that emits blue (Blue: B) light, a second sub-pixel circuit that emits red (Red: R) light, and a third sub-pixel circuit that emits green (Green: G) light, for example.

However, a single pixel is not exclusively formed by the combination of sub-pixel circuits of three primary colors of RGB, and may be formed by the sub-pixel circuits of three primary colors and one or more sub-pixel circuits of different color(s). For example, a single pixel may additionally include a sub-pixel circuit that emits white (White: W) light in order to increase the luminance, or may additionally include at least one sub-pixel circuit that emits light of a complementary color in order to expand the color reproduction range.

In pixel array 30 with m rows and n columns of pixels, power supply line 51 and scan line 61 are arranged for each pixel row in a row direction (a direction of arrangement of pixel circuits 20 in a pixel row). In pixel array 30 with m rows and n columns of pixels, furthermore, signal line 41 is arranged for each pixel column in a column direction (a direction of arrangement of pixel circuits 20 in a pixel column).

Each of a plurality of signal lines 41 is connected to an output end of a corresponding pixel column of horizontal selector 40. Each of the plurality of power supply lines 51 is connected to an output end of a corresponding pixel row of power supply scanner 50. Each of the plurality of scan lines 61 is connected to an output end of a corresponding pixel row of write scanner 60.

Horizontal selector 40 (signal line driving circuit) selectively outputs signal voltage Vsig of a video signal in accordance with luminance information supplied from a signal supply source (not illustrated) and reference potential Vofs. Here, reference potential Vofs is a voltage that is a reference for signal voltage Vsig of a video signal (such as a voltage corresponding to a black level of a video signal), and is used for the threshold correction operation described later.

Signal voltage Vsig and reference potential Vofs output from horizontal selector 40 are written to each pixel circuit 20 of pixel array 30 via signal line 41 on a basis of a pixel row selected by scanning by write scanner 60. That is, horizontal selector 40 is driven in a line sequential write mode in which signal voltage Vsig is written on a row (line) basis.

Note that horizontal selector 40 has only to be able to output at least signal voltage Vsig.

Power supply scanner 50 (power supply scanning circuit) is formed by a shift register circuit that sequentially shifts start pulse sp in synchronization with clock pulse ck, for example. Power supply scanner 50 selectively supplies first potential Vcc or second potential Vss, which is lower than first potential Vcc, to power supply line 51 in synchronization with line sequential scanning by write scanner 60. As described later, whether pixel circuit 20 emits light or does not emit light (extinguish light) may be controlled through switching between first potential Vcc and second potential Vss (switching of a power supply potential).

Write scanner 60 (write scanning circuit) is formed by a shift register circuit that sequentially shifts (transfers) start pulse sp in synchronization with clock pulse ck, for example. When writing signal voltage Vsig of a video signal to each pixel circuit 20 of pixel array 30, write scanner 60 sequentially scans pixel circuits 20 of pixel array 30 on a row basis (line sequential scanning) by sequentially supplying a write scan signal (a write voltage, referred to also as an on signal, hereinafter) to scan lines 61.

Figure 2:
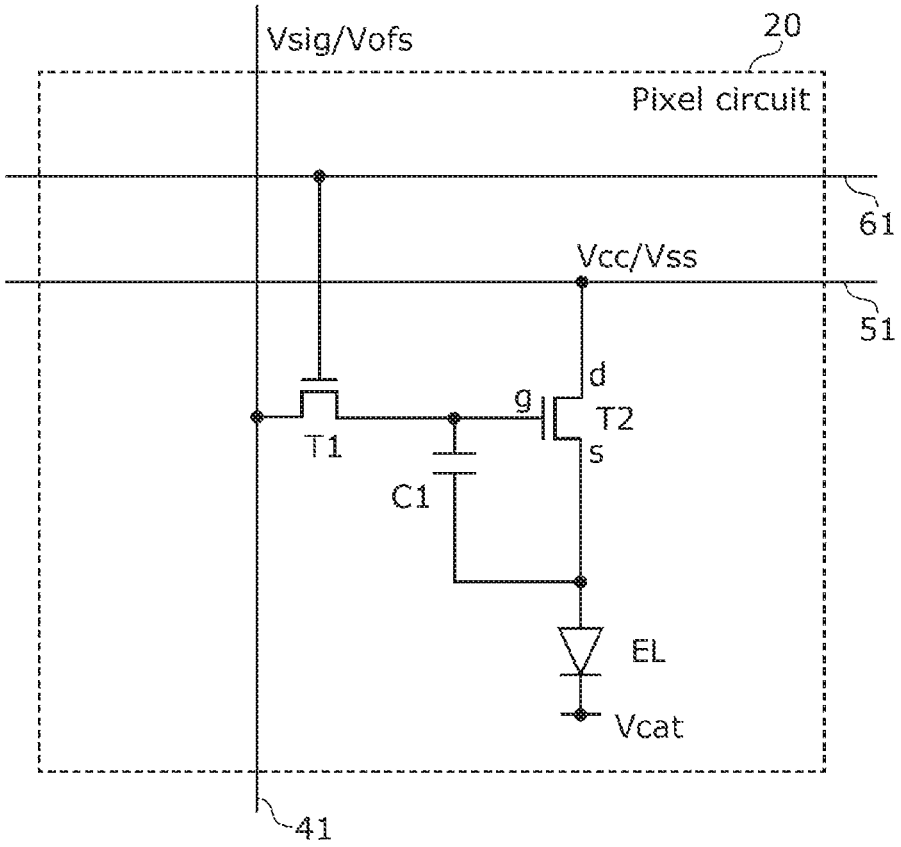
FIG. 2 PRIOR ART
FIG. 2 is a circuit diagram illustrating a pixel circuit according to the related art.

Next, pixel circuit 20 of organic EL display device 1 described above will be described with reference to FIG. 2. FIG. 2 is a circuit diagram illustrating pixel circuit 20 according to the related art.

As illustrated in FIG. 2, pixel circuit 20 is a circuit in which organic EL element EL emits light with a luminance in accordance with a video signal, and has organic EL element EL, holding capacitor C1, write transistor T1, and drive transistor T2. Pixel circuit 20 further has a reference transistor, which is a thin film transistor for applying a reference voltage to holding capacitor C1, and an initialization transistor, which is a thin film transistor for initializing the potential of a first electrode of organic EL element EL, for example.

Organic EL element EL is a light-emitting element having the first electrode and a second electrode. In the example illustrated in FIG. 2, the first electrode and the second electrode are an anode (anode electrode) and a cathode (cathode electrode) of organic EL element EL, respectively. The second electrode of organic EL element EL is connected to a cathode power supply line. Cathode potential Vcat is supplied to the cathode power supply line. Organic EL element EL is an example of the light-emitting element. The cathode power supply line is a line shared between all pixel circuits 20.

Holding capacitor C1 is an element for holding a voltage (such as signal voltage Vsig or reference potential Vofs), and is connected between gate electrode g and source electrode s of drive transistor T2.

Write transistor T1 is a thin film transistor for applying a voltage in accordance with a video signal to holding capacitor C1. Signal line 41 is connected to one of a drain electrode and a source electrode of write transistor T1, and holding capacitor C1 and gate electrode g of drive transistor T2 are connected to the other of the drain electrode and the source electrode of write transistor T1. Scan line 61 is connected to a gate electrode of write transistor T1. Write transistor T1 is turned on by an on signal, for example, to make holding capacitor C1 hold a voltage in accordance with a video signal.

Drive transistor T2 is an N-channel thin film transistor that is connected to the first electrode (anode) of organic EL element EL and supplies a current in accordance with the voltage held by holding capacitor C1 to organic EL element EL. Source electrode s of drive transistor T2 is connected to the first electrode of organic EL element EL, and drain electrode d of drive transistor T2 is connected to power supply line 51. First potential Vcc or second potential Vss is selectively supplied to power supply line 51 from power supply scanner 50.

As write transistor T1 and drive transistor T2, an N-channel thin film transistor (TFT) can be used, for example. However, the combination of the conductivity types of write transistor T1 and drive transistor T2 is not limited thereto.

Depending on the relationship between the potential of the first electrode of organic EL element EL and the potential supplied from power supply line 51, the positional relationship between source electrode s and drain electrode d of drive transistor T2 may be different from the relationship illustrated in FIG. 2.

In pixel circuit 20 of the configuration described above, write transistor T1 enters a conductive state (on state) in response to an on signal applied to the gate electrode through scan line 61 from write scanner 60. This allows write transistor T1 to sample signal voltage Vsig or reference potential Vofs supplied through signal line 41 from horizontal selector 40, and write the sampled voltage or potential into pixel circuit 20. Signal voltage Vsig or reference potential Vofs written by write transistor T1 is applied to gate electrode g of drive transistor T2 and held in holding capacitor C1.

When the power supply potential from power supply line 51 is first potential Vcc, drive transistor T2 operates in a saturation region with drain electrode d on the side of power supply line 51 and source electrode s on the side of organic EL element EL as illustrated in FIG. 2. This allows drive transistor T2 to receive the supply of a current from power supply line 51 and drive organic EL element EL to emit light by current driving. More specifically, by operating in the saturation region, drive transistor T2 makes organic EL element EL emit light by current driving by supplying, to organic EL element EL, a drive current of a current value in accordance with the voltage value of signal voltage Vsig held by holding capacitor C1.

When the power supply potential from power supply line 51 changes from first potential Vcc to second potential Vss, drive transistor T2 operates as a switching transistor with source electrode s on the side of power supply line 51 and drain electrode d on the side of organic EL element EL. This allows drive transistor T2 to stop the supply of the drive current to organic EL element EL to bring organic EL element EL into a non-emission state. That is, drive transistor T2 has a function of a transistor that controls whether organic EL element EL emits light or does not emit light.

By providing a period in which organic EL element EL is in the non-emission state as a result of the switching operation of drive transistor T2 (referred to also as a non-emission period, hereinafter), the ratio (duty) between an emission period and the non-emission period of organic EL element EL can be controlled. The duty control allows an after-image blurring caused by pixel circuit 20 continuing emitting light for the period of one frame to be reduced, and therefore can improve the quality of the video, in particular.

Of first potential Vcc and second potential Vss selectively supplied from power supply scanner 50 through power supply line 51, first potential Vcc is a power supply potential for supplying, to drive transistor T2, the drive current for driving organic EL element EL to emit light. Second potential Vss is a power supply potential for applying a negative bias (reverse bias) to organic EL element EL. That is, second potential Vss is a voltage for reverse biasing the light-emitting element. Second potential Vss is set at a potential lower than reference potential Vofs, such as Vofs−Vth, where Vth represents a threshold voltage of drive transistor T2.

Figure 3:
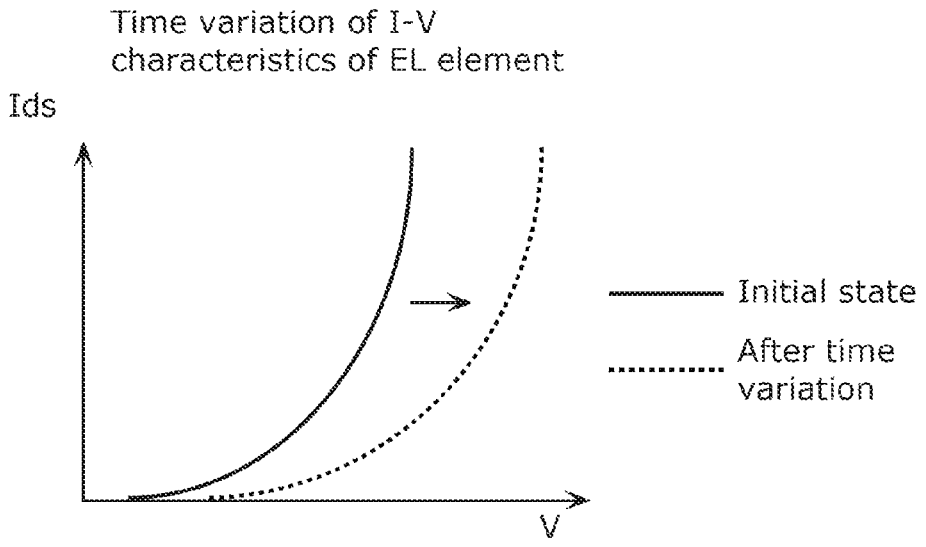
FIG. 3 is a diagram illustrating a time variation of I-V characteristics of an organic EL element.

Here, a time variation of I-V characteristics (current-voltage characteristics) of organic EL element EL will be described with reference to FIG. 3. FIG. 3 is a diagram illustrating a time variation of I-V characteristics of organic EL element EL.

As illustrated in FIG. 3, the I-V characteristics of organic EL element EL vary with time from the I-V characteristics shown by the solid line to the I-V characteristics shown by the dotted line. Provided that Vth represents a threshold voltage of drive transistor T2, μ represents a mobility of drive transistor T2, W represents an effective channel width (effective gate width) of drive transistor T2, L represents an effective channel length (effective gate length) of drive transistor T2, C represents a unit gate capacitance of drive transistor T2, and Vgs represents a voltage between the gate and the source of drive transistor T2, drain-source current Ids is expressed by the formula below.

$$Ids=\frac{1}{2}\times\mu\times W/L\times C(Vgs-Vth)^2 \quad \text{(Expression 1)}$$

Note that drain-source current Ids of drive transistor T2 substantially corresponds to the drive current of organic EL element EL. In the following, for the sake of convenience, an example will be described in which drain-source current Ids corresponds to the drive current of organic EL element EL. The drive current will be referred to also as drive current Ids.

In pixel circuit 20 illustrated in FIG. 2, even if drive transistor T2 is to flow constant drive current Ids, applied voltage V of organic EL element EL increases as can be seen from the graph of FIG. 3, so that the potential of the first electrode (anode) of organic EL element EL (that is, source potential Vs of drive transistor T2) increases. However, since the gate of drive transistor T2 is in a floating state, gate potential Vg also increases with source potential Vs so that substantially constant gate-source voltage Vgs is maintained, and drive current Ids is kept substantially constant. This serves to prevent variations of the light emission luminance of organic EL element EL.

However, threshold voltage Vth and mobility μ of drive transistor T2 vary with pixel circuit 20, and therefore, the current value varies according to Expression 1, and the light emission luminance also varies with pixel circuit 20. Therefore, with pixel circuit 20 having drive transistor T2, in order to reduce variations of threshold voltage Vth and mobility μ, correction operations therefor need to be performed. Such correction operations will be described later.

Figure 4:
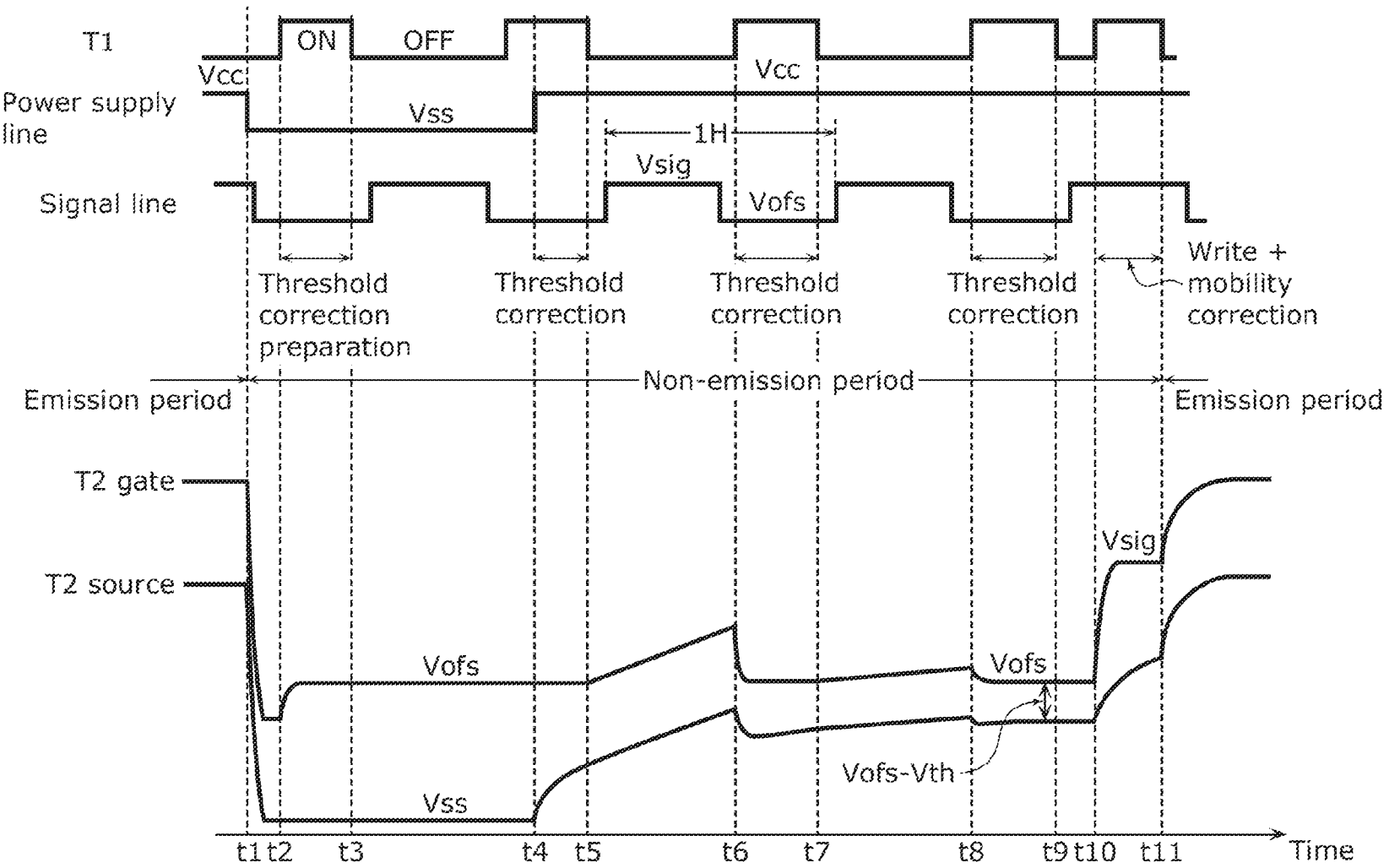
FIG. 4 PRIOR ART
FIG. 4 is a timing chart for illustrating a circuit operation of an organic EL display device according to the related art.

Next, a basic circuit operation of organic EL display device 1 described above will be described with reference to FIG. 4 to FIG. 16. FIG. 4 is a timing chart for illustrating a circuit operation of organic EL display device 1 according to the related art. FIG. 4 illustrates a variation of the potential of the gate electrode of write transistor T1 (which is the potential of scan line 61 and is a high potential (ON) or a low potential (OFF)), a variation of the potential of power supply line 51 (Vcc or Vss), a variation of the potential of signal line 41 (Vsig or Vofs), a variation of the potential of gate electrode g of drive transistor T2 ("T2 GATE" in FIG. 4), and a variation of the potential of source electrode s of drive transistor T2 ("T2 SOURCE" in FIG. 4).

(Emission Period of Previous Displayed Frame)

In the timing chart illustrated in FIG. 4, the period before time t1 is an emission period of organic EL element EL in the previous displayed frame. In the emission period of the previous displayed frame, the potential of power supply line 51 is first potential Vcc (referred to also as high potential Vcc, hereinafter), and write transistor T1 is in a non-conductive state (off state).

Figure 5:
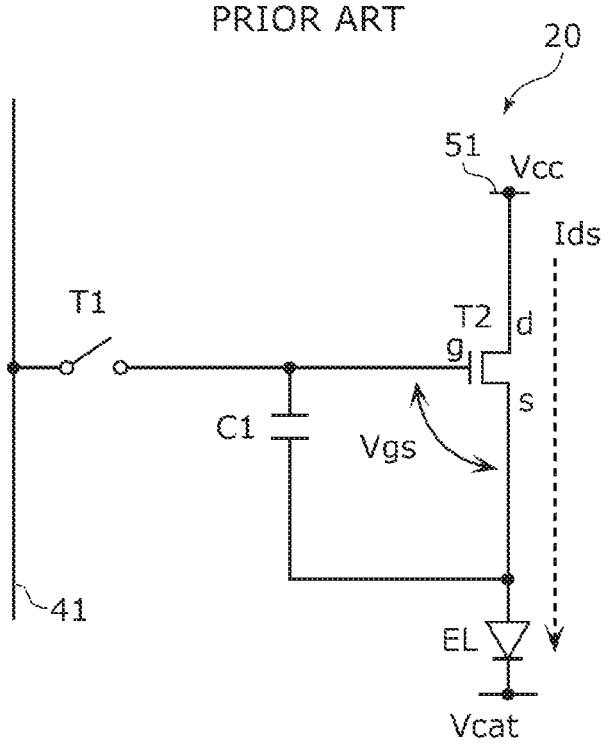
FIG. 5 PRIOR ART
FIG. 5 is a first diagram for illustrating the circuit operation of an organic EL display device according to the related art.

In this state, drive transistor T2 is set to operate in the saturation region. Therefore, as illustrated in FIG. 5, drive current Ids (drain-source current) in accordance with gate-source voltage Vgs of drive transistor T2 is supplied from power supply line 51 to organic EL element EL through drive transistor T2. Therefore, organic EL element EL emits light with a luminance in accordance with the current value of drive current Ids. Note that FIG. 5 is a first diagram for illustrating the circuit operation of organic EL display device 1 according to the related art. Drive current Ids flowing to organic EL element EL assumes a value calculated according to Expression 1 in accordance with gate-source voltage Vgs of drive transistor T2.

(Non-Emission Period)

Figure 6:
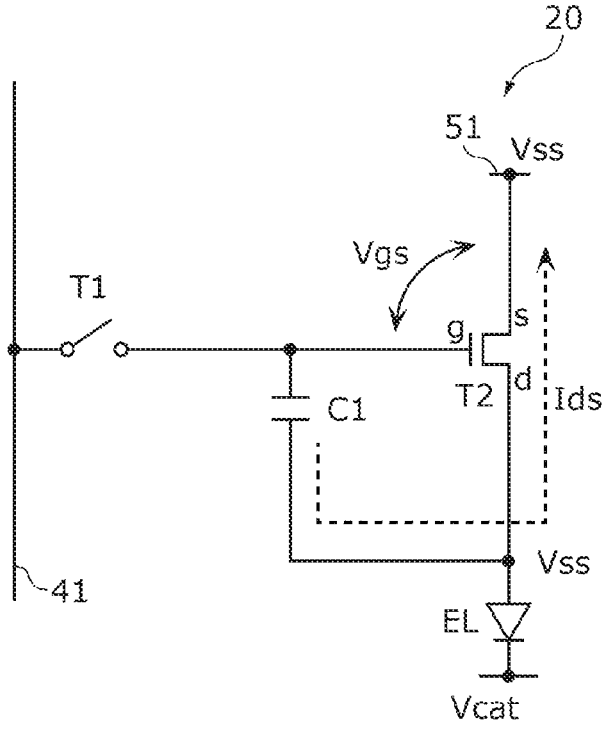
FIG. 6 PRIOR ART
FIG. 6 is a second diagram for illustrating the circuit operation of an organic EL display device according to the related art.

At time t1, the line sequential scanning enters a new displayed frame (current displayed frame). As illustrated in FIG. 6, then, the potential of power supply line 51 changes from high potential Vcc to second potential Vss (referred to also as low potential Vss, hereinafter). Low potential Vss is a potential that is sufficiently lower than reference potential Vofs of signal line 41 or, specifically, sufficiently lower than Vofs−Vth and allows organic EL element EL to be extinguished. Note that FIG. 6 is a second diagram for illustrating the circuit operation of organic EL display device 1 according to the related art.

Here, provided that Vthel represents a threshold voltage of organic EL element EL, and Vcat represents a cathode potential of organic EL element EL, source potential Vs of drive transistor T2 is substantially equal to low potential Vss, and therefore, organic EL element EL enters a reverse biased state and is extinguished, if low potential Vss satisfies the condition indicated below.

$$Vss<Vthel+Vcat \quad \text{(Expression 2)}$$

The electrode of drive transistor T2 on the side of power supply line 51 becomes source electrode s. The first electrode (anode) of organic EL element EL is then charged to low potential Vss.

(Threshold Correction Preparation Period)

Figure 7:
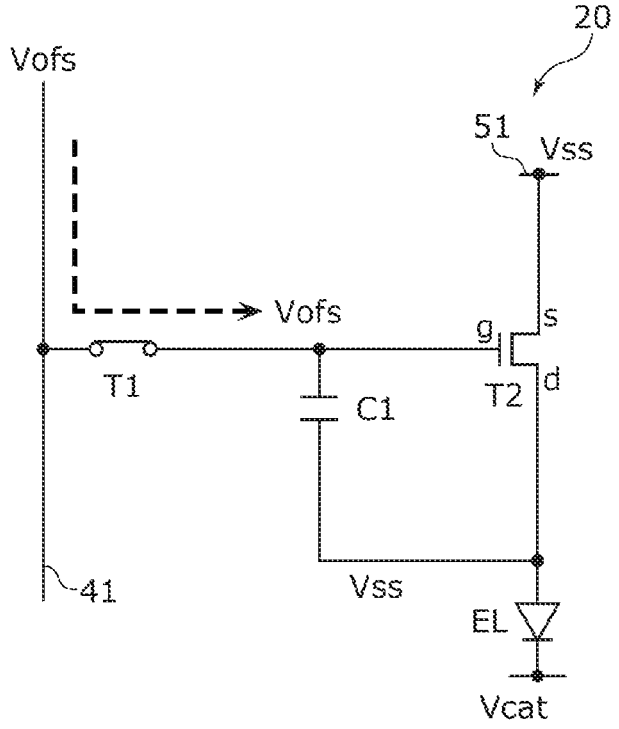
FIG. 7 PRIOR ART
FIG. 7 is a third diagram for illustrating the circuit operation of an organic EL display device according to the related art.

At time t2, the potential of scan line 61 transitions from a low potential side to a high potential side (from OFF to ON), and write transistor T1 enters a conductive state as illustrated in FIG. 7. FIG. 7 is a third diagram for illustrating the circuit operation of organic EL display device 1 according to the related art.

In this state, reference potential Vofs is being supplied to signal line 41 from horizontal selector 40, gate potential Vg of drive transistor T2 becomes reference potential Vofs. Source potential Vs of drive transistor T2 is a potential that is sufficiently lower than reference potential Vofs, that is, low potential Vss.

At this time, gate-source voltage Vgs of drive transistor T2 is Vofs−Vss. Here, the threshold correction operation described later cannot be performed if Vofs−Vss is not greater than threshold voltage Vth of drive transistor T2. Therefore, the potentials need to be set to satisfy the potential relationship below.

$$Vofs-Vss>Vth \quad \text{(Expression 3)}$$

Such a process of fixing gate potential Vg of drive transistor T2 at reference potential Vofs and fixing source potential Vs at low potential Vss for initialization is a preparation (threshold correction preparation) process before the threshold correction operation described later is performed. Therefore, reference potential Vofs and low potential Vss are initial potentials of gate potential Vg and source potential Vs of drive transistor T2, respectively.

At time t3, the potential of scan line 61 transitions from the high potential side to the low potential side (from ON to OFF), and the threshold correction preparation period ends. The period from time t2 to time t3 is a threshold correction preparation period.

(Threshold Correction Period)

Figure 8:
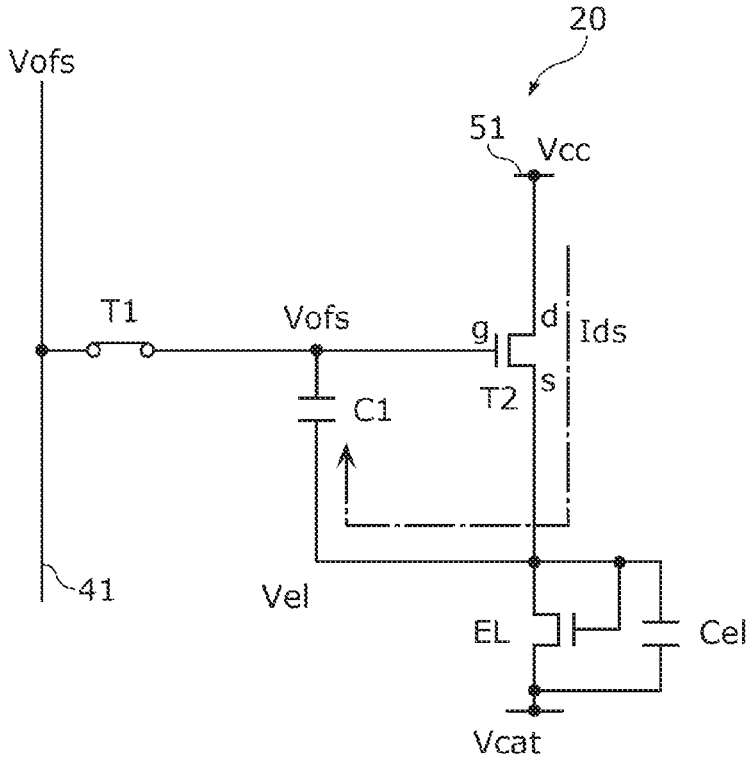
FIG. 8 PRIOR ART
FIG. 8 is a fourth diagram for illustrating the circuit operation of an organic EL display device according to the related art.

After that, at time t4, when the potential of power supply line 51 changes from low potential Vss to high potential Vcc in the state where write transistor T1 is conductive, the first electrode of organic EL element EL becomes source electrode s of drive transistor T2, and a current flows to drive transistor T2 as illustrated in FIG. 8. Then, a threshold correction period starts in a state where gate potential Vg of drive transistor T2 is kept at reference potential Vofs. That is, source potential Vs of drive transistor T2 starts rising to a potential (Vofs−Vth) calculated by subtracting threshold voltage Vth of drive transistor T2 from gate potential Vg. Note that FIG. 8 is a fourth diagram for illustrating the circuit operation of organic EL display device 1 according to the related art.

Here, for the sake of convenience, an operation (process) of changing source potential Vs to a potential calculated by subtracting threshold voltage Vth of drive transistor T2 from reference potential Vofs (initial potential) of gate potential Vg of drive transistor T2 is referred to as a threshold correction operation (threshold correction process). As the threshold correction operation proceeds, gate-source voltage Vgs of drive transistor T2 converges to threshold voltage Vth of drive transistor T2. The voltage corresponding to threshold voltage Vth is held by holding capacitor C1.

Note that, in the period of the threshold correction operation (the threshold correction period in FIG. 4), in order to ensure that the current flows to holding capacitor C1 and does not flow to organic EL element EL, cathode potential Vcat of the cathode power supply line is set so that organic EL element EL is in a cut-off state (high impedance state).

An equivalent circuit of organic EL element EL is represented by a diode and equivalent capacitor Cel, as illustrated in FIG. 8. Provided that the source potential of drive transistor T2 is represented by Vel, the current through drive transistor T2 is used to charge holding capacitor C1 and equivalent capacitor Cel, as far as the following relationship holds.

$$Vel \leq Vcat + Vthel \quad \text{(Expression 4)}$$

For example, the current through drive transistor T2 is used to charge holding capacitor C1 and equivalent capacitor Cel, as far as a leak current of organic EL element EL is significantly smaller than the current flowing through drive transistor T2. Note that source potential Vel is also the potential of the first electrode of organic EL element EL.

Figure 9:
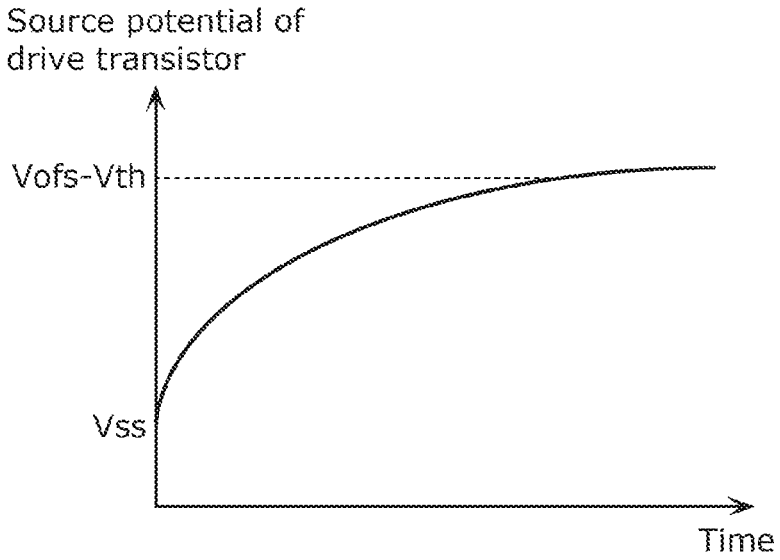
FIG. 9 PRIOR ART
FIG. 9 is a diagram illustrating a variation of a source potential of a drive transistor of an organic EL display device according to the related art.

A variation of source potential Vel will be described with reference to FIG. 9. FIG. 9 is a diagram illustrating a variation of source potential Vel of drive transistor T2 of organic EL display device 1 according to the related art. FIG. 9 is a diagram schematically illustrating a variation of source potential Vel in the threshold correction operation.

As illustrated in FIG. 9, source potential Vel rises with time. Source potential Vel gradually rises from Vss to Vofs−Vth.

Figure 10:
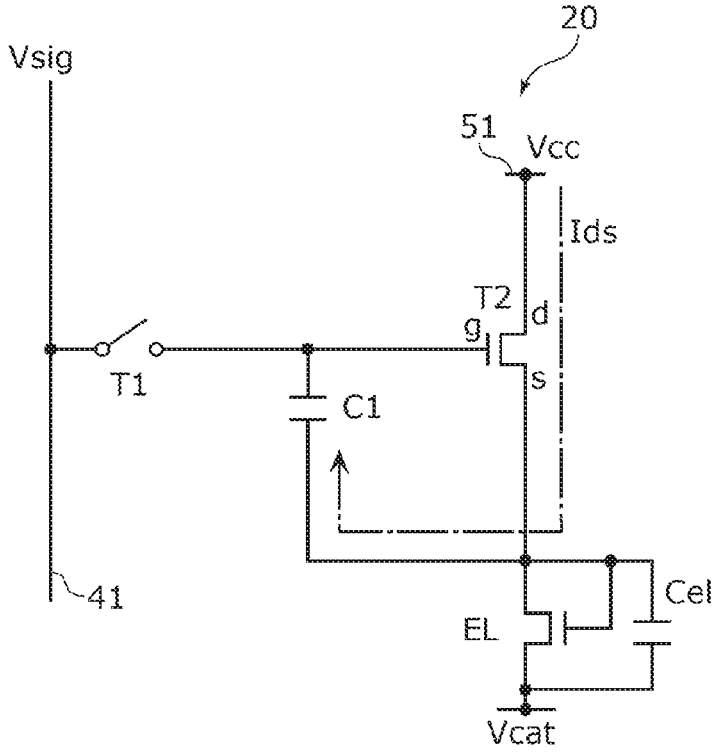
FIG. 10 PRIOR ART
FIG. 10 is a fifth diagram for illustrating the circuit operation of an organic EL display device according to the related art.

After that, at time t5, the potential of scan line 61 transitions to the low potential side (from ON to OFF), and write transistor T1 enters the non-conductive state. Write transistor T1 enters the non-conductive state at time t5 when a first period has elapsed since time t4. At this time, gate electrode g of drive transistor T2 is electrically disconnected from signal line 41 and therefore enters the floating state. However, since gate-source voltage Vgs is higher than threshold voltage Vth of drive transistor T2, a current (drain-source current Ids) flows, and the gate potential and the source potential of drive transistor T2 rise, as illustrated in FIG. 10. Note that, at this time, since organic EL element EL is reverse biased, organic EL element EL does not emit light. Note that FIG. 10 is a fifth diagram for illustrating the circuit operation of organic EL display device 1 according to the related art.

After that, at time t6, the threshold correction operation is started again, with write transistor T1 in the conductive state. Time t6 is a time within a period in which the potential of signal line 41 is reference potential Vofs, and may be the time when the potential has become reference potential Vofs. By repeating this operation, gate-source voltage Vgs of drive transistor T2 eventually assumes the value of threshold voltage Vth. Source potential Vel of drive transistor T2 then satisfies the relationship below.

$$Vel = Vofs - Vth \leq Vcat + Vthel \quad \text{(Expression 5)}$$

After that, at time t7, the potential of scan line 61 transitions to the low potential side (from ON to OFF), and write transistor T1 enters the non-conductive state. Write transistor T1 enters the non-conductive state at time t7 when a second period has elapsed since time t6.

In the period from time t8 to time t9, the threshold correction operation is performed again. Time t9 is a time when the threshold correction operation ends, and write transistor T1 enters the non-conductive state. The periods from time t4 to time t5, from time t6 to time t7, and from time t8 to time t9 are the threshold correction periods.

As described above, in addition to performing the threshold correction operation along with a write operation and a mobility correction operation in one horizontal period (1H), organic EL display device 1 may perform a so-called divisional threshold correction operation, in which the threshold correction operation is performed a plurality of times in a divisional manner in a plurality of horizontal periods preceding the one horizontal period.

With the divisional threshold correction operation, even if the time assigned as one horizontal period is reduced due to an increase of the number of pixels for higher definition, a sufficient time can be ensured as the threshold correction period by the plurality of horizontal periods. Therefore, with the divisional threshold correction operation, since a sufficient time can be ensured as the threshold correction period can be ensured even if the time assigned as the one horizontal period is reduced, the threshold correction operation can be performed with reliability. Note that the number of the threshold correction operations is not limited to that described above, and only one threshold correction operation may be performed.

(Write and Mobility Correction Period)

Figure 11:
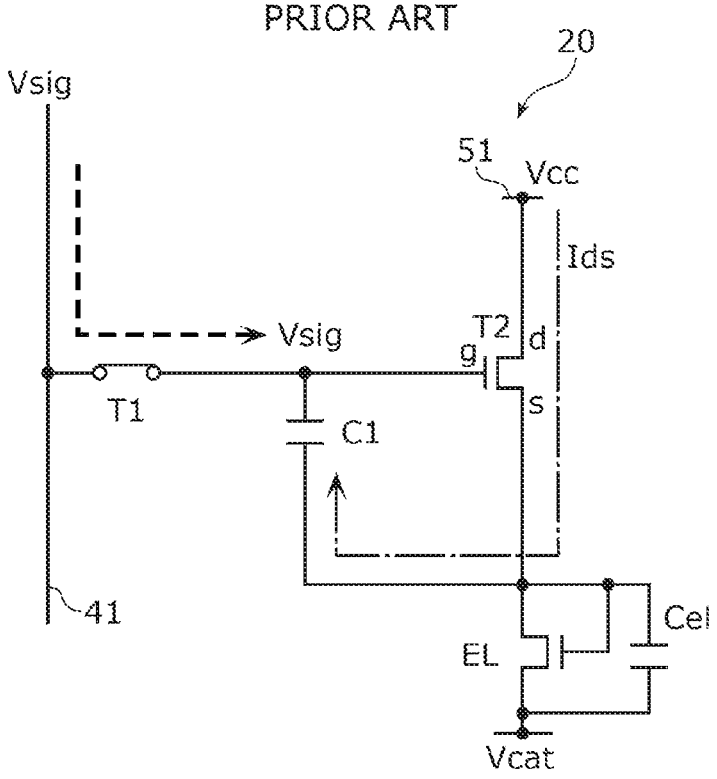
FIG. 11 PRIOR ART
FIG. 11 is a sixth diagram for illustrating the circuit operation of an organic EL display device according to the related art.

After that, at time t10, in a state where the potential of signal line 41 has changed from reference potential Vofs to signal voltage Vsig of the video signal, the potential of scan line 61 transitions to the high potential side (from OFF to ON), and write transistor T1 enters the conductive state, and signal voltage Vsig of the video signal is sampled and written into pixel circuit 20, as illustrated in FIG. 11. Note that FIG. 11 is a sixth diagram for illustrating the circuit operation of organic EL display device 1 according to the related art. Signal voltage Vsig is a voltage in accordance with the tone of the video signal.

As a result of the writing of signal voltage Vsig by write transistor T1, gate potential Vg of drive transistor T2 is set to be signal voltage Vsig. At this time, organic EL element EL is in the cut-off state. Therefore, the current (drain-source current Ids) flowing from power supply line 51 to drive transistor T2 in accordance with signal voltage Vsig of the video signal flows into holding capacitor C1 and equivalent capacitor Cel. In this way, charging of holding capacitor C1 and equivalent capacitor Cel is started.

For example, if source potential Vs of drive transistor T2 does not exceed the sum of threshold voltage Vthel and cathode potential Vcat of organic EL element EL, the current of drive transistor T2 is used to charge holding capacitor C1 and equivalent capacitor Cel.

As a result of equivalent capacitor Cel of organic EL element EL being charged, source potential Vs of drive transistor T2 rises with time. At this time, variations of threshold voltage Vth of drive transistor T2 between pixel circuits 20 have already been canceled by the threshold correction operation, and drain-source current Ids of drive transistor T2 depends on mobility μ of drive transistor T2 (see Expression 1). Therefore, gate-source voltage Vgs of drive transistor T2 decreases reflecting mobility μ, and assumes a value that completely corrects mobility μ when a certain time has elapsed. Note that mobility μ of drive transistor T2 is a mobility of a semiconductor thin film forming a channel of drive transistor T2.

Figure 12:
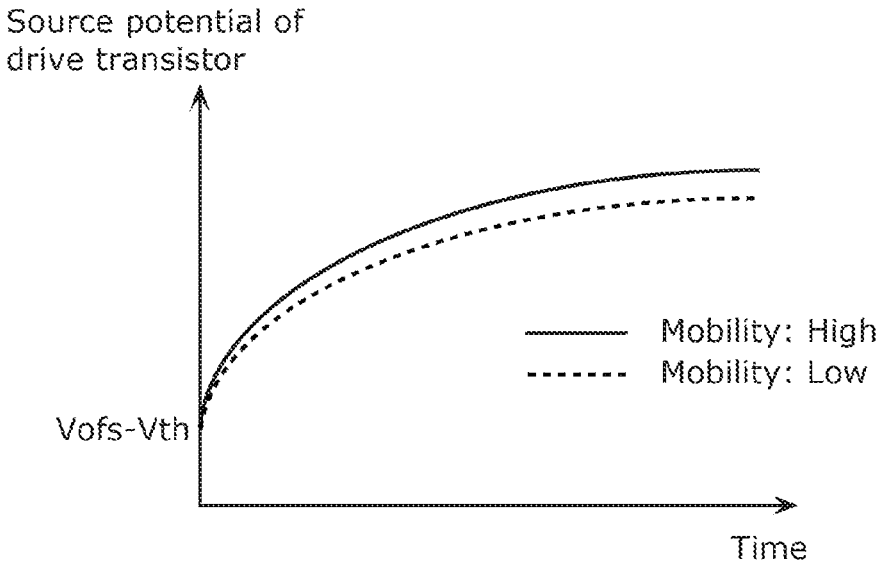
FIG. 12 PRIOR ART
FIG. 12 is a diagram illustrating a relationship between a source potential and a mobility of a drive transistor of an organic EL display device according to the related art.

FIG. 12 is a diagram illustrating a relationship between source potential Vs and mobility μ of drive transistor T2 of organic EL display device 1 according to the related art. FIG. 12 is a diagram illustrating variations of source potential Vs for different mobilities μ.

As illustrated in FIG. 12, with pixel circuit 20 having drive transistor T2 having relatively high mobility μ, the amount of the current of drive transistor T2 is great, and source potential Vs quickly rises compared with the case where mobility μ is relatively low. With pixel circuit 20 having drive transistor T2 having relatively low mobility μ, the amount of the current of drive transistor T2 is small, and source potential Vs slowly rises compared with the case where mobility μ is relatively high.

For example, a case will be described where signal voltage Vsig of the same level is written to gate electrodes g of drive transistors T2 of two pixel circuits 20 having different mobilities μ. In this case, if the mobility correction is not performed, drain-source current Ids flowing through pixel circuit 20 having high mobility μ and drain-source current Ids flowing through pixel circuit 20 having low mobility μ significantly differ. If such a significant difference of drain-source current Ids occurs due to the variations of mobility μ between pixel circuits 20, the uniformity (such as the uniformity of brightness) of the image is compromised.

To avoid this, the mobility correction is performed as described above. The mobility correction will be further described below.

Assuming that the ratio of the voltage held by holding capacitor C1 to signal voltage Vsig of the video signal, that is, a write gain, is 1 (ideal value), when source potential Vs of drive transistor T2 rises by ΔVs from Vofs−Vth, gate-source voltage Vgs of drive transistor T2 becomes Vsig−Vofs+Vth−ΔVs. ΔVs represents an increment of source potential Vs.

That is, increment ΔVs of source potential Vs of drive transistor T2 is subtracted from the voltage (Vsig−Vofs+Vth) held by holding capacitor C1 or, in other words, means that holding capacitor C1 is discharged. In other words, increment ΔVs of source potential Vs of drive transistor T2 means applying a negative feedback to holding capacitor C1. Therefore, increment ΔVs of source potential Vs is a feedback amount of the negative feedback.

As described above, by applying a negative feedback to gate-source voltage Vgs with feedback amount ΔVs in accordance with drain-source current Ids flowing through drive transistor T2, the dependence of the drain-source current Ids of drive transistor T2 on mobility μ can be cancelled. The canceling operation is the mobility correction operation that compensates for variations of mobility μ of drive transistor T2 between pixel circuits 20.

More specifically, when the correction with feedback amount ΔVs is applied to pixel circuit 20 having high mobility μ, drain-source current Ids substantially decreases from a first current value to a second current value. On the other hand, feedback amount ΔVs of pixel circuit 20 having low mobility μ is small, and drain-source current Ids decreases from a third current value (<the first current value) to a fourth current value. By performing the mobility correction for a period in which the second current value and the fourth current value are equal to each other, variations of mobility μ between pixel circuits 20 are compensated for. It can also be said that feedback amount ΔVs of the negative feedback is a correction amount of the mobility correction operation.

The greater the signal amplitude (Vsig−Vofs) of the video signal written to gate electrode g of drive transistor T2, the greater drain-source current Ids is, and therefore, the greater the absolute value of feedback amount ΔVs of the negative feedback is. Therefore, the mobility correction operation is performed in accordance with the light emission luminance level.

(Emission Period)

After that, time t11, the potential of scan line 61 transitions to the low potential side (from ON to OFF), write transistor T1 enters the non-conductive state, and the write operation ends. As a result, gate electrode g of drive transistor T2 is electrically disconnected from signal line 41 and enters the floating state. The period from time t10 to time t11 is a write and mobility correction period.

Here, when gate electrode g of drive transistor T2 is in the floating state, gate potential Vg varies in association with the variation of source potential Vs of drive transistor T2, since holding capacitor C1 is connected between the gate and the source of drive transistor T2. That is, source potential Vs and gate potential Vg of drive transistor T2 rise while maintaining gate-source voltage Vgs held by holding capacitor C1. Source potential Vs of drive transistor T2 rises to a light emission voltage of organic EL element EL in accordance with drain-source current Ids (saturation current) of drive transistor T2.

Such an operation in which gate potential Vg of drive transistor T2 varies in association with the variation of source potential Vs is a bootstrap operation. In other words, the bootstrap operation is an operation in which gate potential Vg and source potential Vs vary while maintaining gate-source voltage Vgs held by holding capacitor C1, that is, the voltage between the ends of holding capacitor C1.

Figure 13:
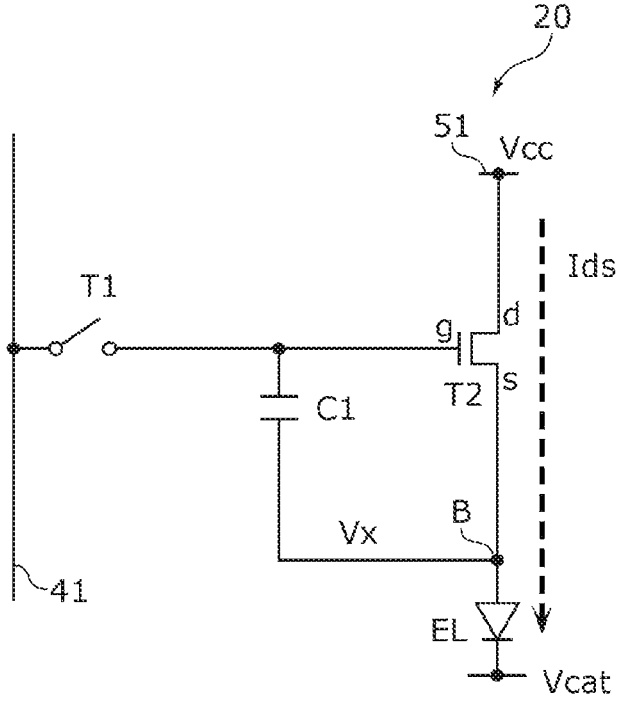
FIG. 13 PRIOR ART
FIG. 13 is a seventh diagram for illustrating the circuit operation of an organic EL display device according to the related art.

As a result of gate electrode g of drive transistor T2 entering the floating state and, at the same time, drain-source current Ids of drive transistor T2 starting flowing to organic EL element EL, the potential of the first electrode (anode) of organic EL element EL rises to potential Vx in accordance with drain-source current Ids, as illustrated in FIG. 13. When potential Vx (such as the potential at point B in FIG. 13) of the first electrode of organic EL element EL exceeds Vthel+Vcat, drive current Ids starts flowing to organic EL element, and therefore, organic EL element EL starts emitting light. Note that FIG. 13 is a seventh diagram for illustrating the circuit operation of organic EL display device 1 according to the related art.

With pixel circuit 20 described above, organic EL element EL varies (deteriorates) in I-V characteristics as the light emission continues for a long time, that is, organic EL element EL varies (deteriorates) with time in I-V characteristics. Therefore, the potential at point B in FIG. 13 also varies. However, gate-source voltage Vgs of drive transistor T2 is kept at a constant value, and therefore, the current flowing to organic EL element EL does not vary. Therefore, even if I-V characteristics of organic EL element EL varies, constant drive current Ids continues flowing, and the light emission luminance of organic EL element EL does not vary.

Figure 14:
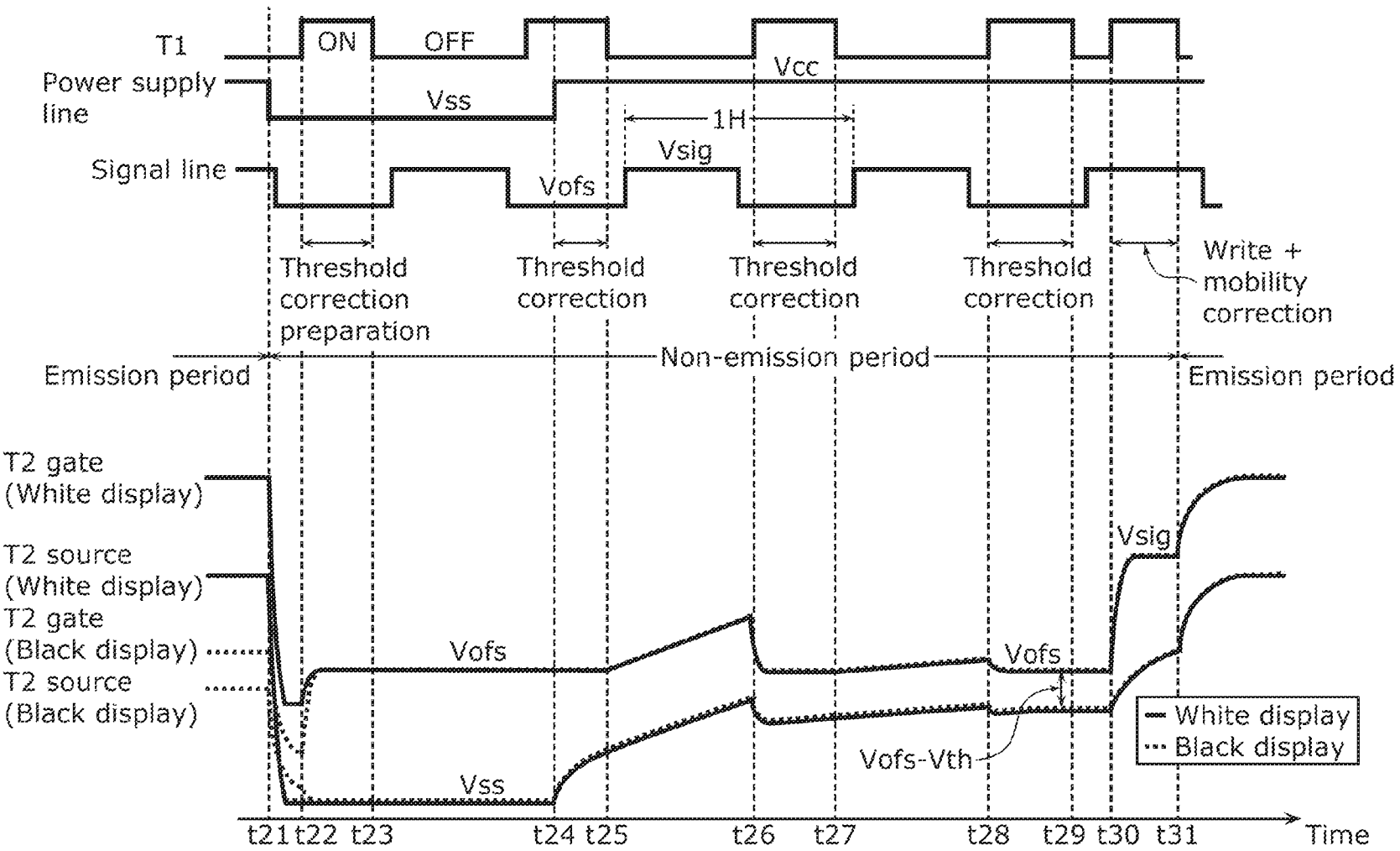
FIG. 14 PRIOR ART
FIG. 14 is a diagram illustrating variations of a gate potential and a source potential of a drive transistor in a case where an organic EL display device according to the related art shows a white display and a black display.

Here, variations of gate potential Vg and source potential Vs of drive transistor T2 in pixel display (such as white display and black display) will be described with reference to FIG. 14. FIG. 14 is a diagram illustrating variations of gate potential Vg and source potential Vs of drive transistor T2 in a case where organic EL display device 1 according to the related art shows a white display and a black display. In FIG. 14, switching from the emission period to the non-emission period is achieved by changing the voltage supplied to power supply line 51 from first potential Vcc to second potential Vss lower than first potential Vcc. At this time, power supply line 51 shifts to the side of source electrode s of drive transistor T2 as described above, and the anode of organic EL element EL is charged to second potential Vss (see FIG. 6). Note that times t21 to t31 illustrated in FIG. 14 are the same as times t1 to t11 illustrated in FIG. 4 and therefore will not be further described. Note that the white display and the black display mean that both a white display region (such as a bar display region) and the remaining black display region are shown in one video. The video may be a static image or a moving image.

Variations (that is, variations of source potentials Vs of drive transistors T2) of the potentials (anode potentials) of the anodes of organic EL elements EL of a pixel showing a white display and a pixel showing a black display in the emission period in the case where the potential supplied to power supply line 51 is changed from first potential Vcc to second potential Vss will be discussed.

In the case where the white display is shown in the emission period, gate potential Vg (see T2 GATE (WHITE DISPLAY) (solid line) illustrated in FIG. 14) of drive transistor T2 at the time when the potential supplied to power supply line 51 from first potential Vcc to second potential Vss (at the time of switching from the emission period to the non-emission period) at time t21 is greater than when the black display is shown in the emission period. Therefore, gate-source voltage Vgs (gate potential Vg of drive transistor T2−second potential Vss) of drive transistor T2 at the time of the switching from first potential Vcc to second potential Vss is greater than when the black display is shown in the emission period. The anode of organic EL element EL is then quickly charged to second potential Vss.

On the other hand, in the case where the black display is shown in the emission period, gate potential Vg (see T2 GATE (BLACK DISPLAY) (dashed line) illustrated in FIG. 14) of drive transistor T2 at the time when the potential supplied to power supply line 51 from first potential Vcc to second potential Vss is smaller than when the white display is shown in the emission period. Therefore, gate-source voltage Vgs (gate potential Vg of drive transistor T2−second potential Vss) of drive transistor T2 at the time of the switching from first potential Vcc to second potential Vss is smaller than when the white display is shown in the emission period. The anode of organic EL element EL is then slowly charged to second potential Vss. That is, when the black display is shown in the emission period, the anode potential of organic EL element EL more slowly varies when the black display is shown in the emission period than when the white display is shown in the emission period.

Figure 15:
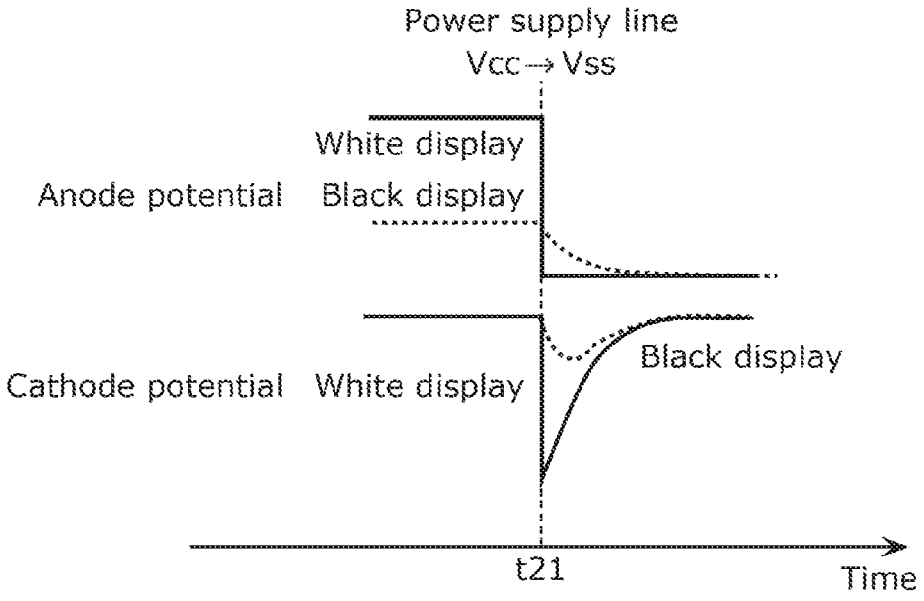
FIG. 15 PRIOR ART
FIG. 15 is a diagram schematically illustrating variations of an anode potential and a cathode potential of an organic EL display device according to the related art.

As described above, when the potential supplied to power supply line 51 is changed from first potential Vcc to second potential Vss (power supply line: Vcc→Vss), the anode potential of organic EL element EL quickly varies in the case of the white display, and slowly varies in the case of the black display. The variation of the anode potential is input to the cathode through organic EL element EL, and as a result, the potential (cathode potential Vcat) of the cathode varies. FIG. 15 is a diagram schematically illustrating variations of the anode potential and cathode potential Vcat of organic EL display device 1 according to the related art. Potential variations in the case of the white display are shown by solid lines, and potential variations in the case of the black display are shown by dashed lines.

As illustrated in FIG. 15, since the cathode is grounded at a predetermined potential, cathode potential Vcat recovers to the predetermined potential after a certain time elapses. However, the amount of fluctuation of cathode potential Vcat differs between the white display and the black display. That is, the amount of fluctuation of cathode potential Vcat varies depending on whether the display at the time of the switching from first potential Vcc to second potential Vss is the white display or the black display. Note that, as is obvious from FIG. 15, the greater the amount of variation of the anode potential, the greater the amount of fluctuation of cathode potential is. That is, the amount of fluctuation of cathode potential Vcat is greater in the case of the white display than in the case of the black display. The amount of fluctuation of cathode potential Vcat means the amount of variation of cathode potential Vcat at time t21, for example.

Figure 16:
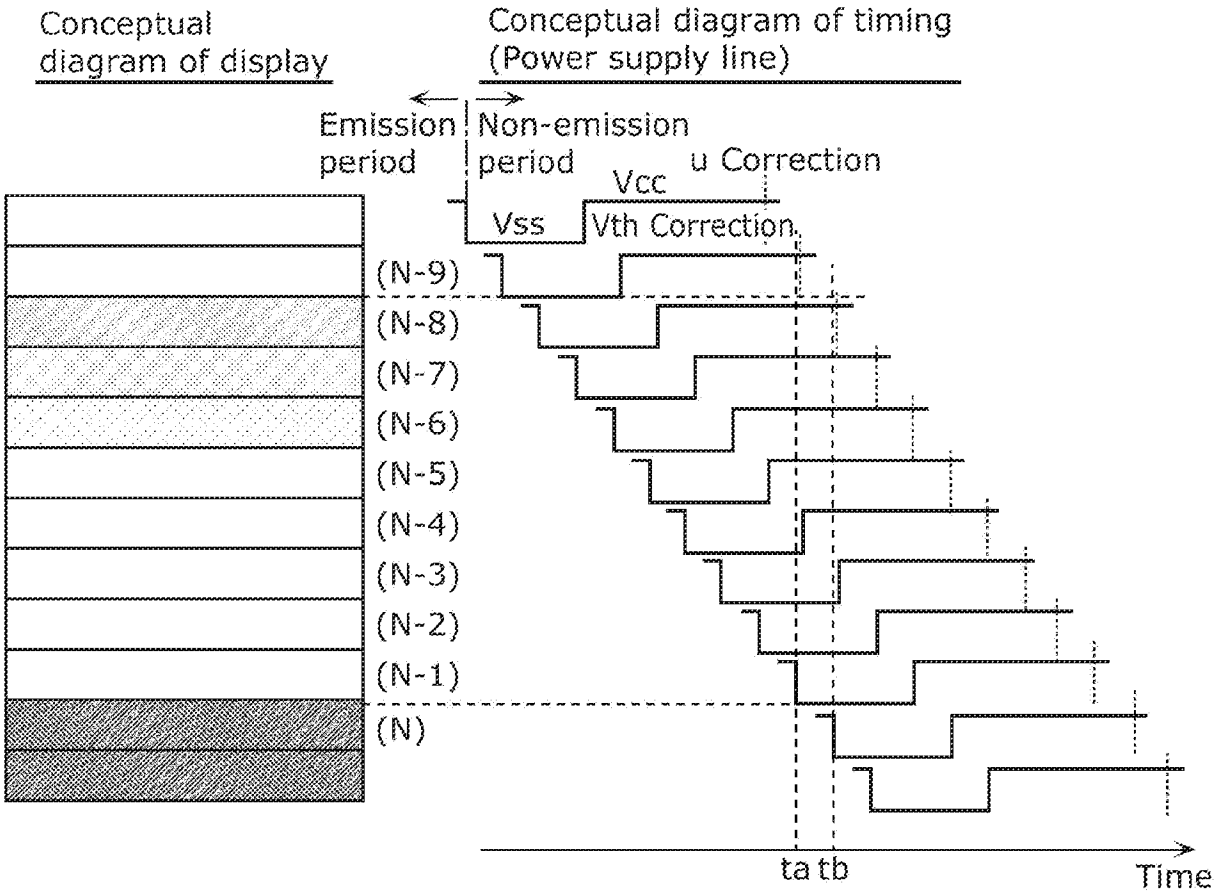
FIG. 16 PRIOR ART
FIG. 16 is a diagram for illustrating a display unevenness that occurs when a display of an organic EL display device according to the related art changes from a white display to a black display.

The difference in the amount of fluctuation of cathode potential Vcat is a cause of the deterioration of the display quality of organic EL display device 1. A relationship between the difference in the amount of fluctuation of cathode potential Vcat and the display quality will be described with reference to FIG. 16. FIG. 16 is a diagram for illustrating a display unevenness that occurs when the display of organic EL display device 1 according to the related art changes from the white display to the black display. FIG. 16 illustrates a case where the display of organic EL display device 1 changes from the white display to the black display. The display unevenness herein is a streak unevenness along the line direction. Note that that the display changes from the white display to the black display means that the display changes from the white display to the black display midway in a scan direction (such as a direction from top to bottom of a sheet of paper) in one video.

The conceptual diagram of the display illustrated in FIG. 16 is a conceptual diagram of a video continuously displayed by organic EL display device 1, which is a conceptual diagram of a video in a case where the white display occurs in an (N−1) line ((N−1)-th pixel row) and the lines higher than the (N−1) line, and the black display occurs in an N line (N-th pixel row) and the lines lower than the N line, that is, in a case where signal voltage Vsig for the white display is supplied to the (N−1) line and the higher lines and signal voltage for the black display is supplied to the N line and the lower lines in the emission period. The density of the dot hatching in the conceptual diagram indicates the degree of the darkness of the black display, and the higher the density of the dot hatching, the higher the darkness is. Note that equal signal voltage Vsig is input to each of the lines for the white display, and equal signal voltage Vsig is input to each of the lines for the black display.

The conceptual diagram of the timing illustrated in FIG. 16 shows variations of the voltage of the power supply line for the respective lines. In FIG. 16, at time ta, the power supply line of the (N−1)-th line varies from first potential Vcc to second potential Vss, that is, the (N−1)-th line shifts from the emission period to the non-emission period. In FIG. 16, at time tb, the power supply line of the N-th line varies from first potential Vcc to second potential Vss, that is, the N-th line shifts from the emission period to the non-emission period. Note that "Vth CORRECTION" in the non-emission period indicates that the threshold correction operation is performed, and "u CORRECTION" indicates that the mobility correction is performed. Note that although FIG. 16 illustrates an example where scanning occurs from top to bottom of the sheet of paper, the present disclosure is not limited thereto.

As illustrated in FIG. 16, time ta is a timing at which the power supply line of the (N−1)-th line varies from first potential Vcc to second potential Vss, that is, a timing at which the line showing the white display is extinguished. At time ta, the threshold correction operation is about to end in the (N−9)-th line. Time tb is a timing at which the power supply line of the N-th line varies from first potential Vcc to second potential Vss, that is, a timing at which the line showing the black display is extinguished. At time tb, the threshold correction operation is about to end in the (N−8)-th line.

Here, as described above, the amount of fluctuation of cathode potential Vcat at time ta and the amount of fluctuation of cathode potential Vcat at time tb differ, or more specifically, the amount of fluctuation of cathode potential Vcat at time tb is smaller. That is, the amount of fluctuation of cathode potential Vcat at the time when the N-th line shifts from the emission period to the non-emission period is smaller than the amount of fluctuation of cathode potential Vcat at the time when the (N−1)-th line shifts from the emission period to the non-emission period.

The fluctuation of cathode potential Vcat is input to organic EL elements EL of the other lines through organic EL element EL of that line. The fluctuation of cathode potential Vcat is also input to the anode of organic EL element EL for which the threshold correction operation is about to end. For example, the fluctuation of cathode potential Vcat of the N-th line is also input to organic EL element EL of the (N−8)-th line. At the cathode, cathode potential Vcat fluctuates in a direction toward lower potentials. Therefore, due to the fluctuation of cathode potential Vcat of the N-th line, the anode potential of organic EL element EL of the (N−8)-th line also fluctuates in a direction toward lower potentials, for example. In other words, in the other lines including the (N−8)-th line, gate-source voltage Vgs of drive transistor t2 increases because of the fluctuation of the anode potential. The amount of variation of gate-source voltage Vgs of each of the other lines varies depending on whether the line shows the white display or the black display.

For example, the amount of variation of gate-source voltage Vgs of the (N−9)-th line at the time when the (N−1)-th line shifts from the emission period to the non-emission period at time ta is greater than the amount of variation of gate-source voltage Vgs of the (N−8)-th line at the time when the N-th line shifts from the emission period to the non-emission period at time tb. The difference in the amount of variation of gate-source voltage Vgs causes a streak unevenness that involves slight darkening of the display in the (N−8)-th line or the like.

In the conceptual diagram of the display, the density of the streaks gradually decreases from the (N−8)-th line to the (N−7)-th line, and from the (N−7)-th line to the (N−6)-th line. This is because, at time tb, the threshold correction operation is still in progress in the (N−7)-th line and the (N−6)-th line, and the fluctuation of cathode potential Vcat of the N-th line (line showing the black display) is input to the lines during the threshold correction operation. That is, in the (N−7)-th line and the (N−6)-th line, the remaining time of the threshold correction operation is longer than in the (N−8)-th line, so that gate-source voltage Vgs of drive transistor T2 is relatively high at time tb. In addition, the variation of gate-source voltage Vgs of drive transistor T2 due to the fluctuation of the anode potential is reduced by the subsequent threshold correction operation. Therefore, in the (N−7)-th line and the (N−6)-th line, the density of the streaks is lower than in the (N−8)-th line. In addition, in the (N−6)-th line, the remaining time of the threshold correction operation is longer than in the (N−7)-th line, so that the density of the streaks is lower than in the (N−7)-th line. In addition, in the (N−8)-th line for which the threshold correction operation is about to end, the variation of gate-source voltage Vgs is less likely to be reduced, the density of the streaks tends to be high. Note that, at time tb, the (N−9)-th line has already shifted to the emission period and therefore is not affected by the fluctuation of cathode potential Vcat of the N-th line. That is, streaks are less likely to occur in the (N−9)-th line.

As described above, the difference in display (such as whether the black display or the white display) of organic EL element EL at the time when second potential Vss (power supply potential for applying a negative bias (reverse bias) to organic EL element EL) is input to organic EL element EL causes a difference in the fluctuation of cathode potential Vcat, and the fluctuation of cathode potential Vcat is input to a line (pixel row) in which the threshold correction operation is in progress. This is a possible cause of the display unevenness illustrated in FIG. 16.

Note that although the display unevenness markedly occurs in a bar display that involves showing a white display in a plurality of successive lines, a similar problem can occur in a window display that involves showing a white display only in a small window in an image, even though the density of the display unevenness is lower.

In view of the above description, the present inventors have earnestly studied a method of driving a pixel circuit that can reduce such a display unevenness caused by a fluctuation of cathode potential Vcat and the like, and devised the method of driving a pixel circuit described below and the like.

In the following, an embodiment of the present disclosure will be described with reference to the drawings. Note that the embodiment described below is a specific example of the present disclosure. Therefore, the numerical values, shapes, materials, components, positions of the components arranged, ways of connection of the components, steps, orders of the steps and the like are examples and are not intended to limit the present disclosure. Therefore, of the components according to the embodiment described below, components that are not described in the dependent claims of the present disclosure will be described as optional components.

Note that the drawings are schematic diagrams and are not necessarily precise illustrations. In the drawings, substantially the same components are denoted by the same reference numerals, and redundant descriptions will be omitted or simplified.

In this specification, terms indicating relationships between elements, such as equal or constant, and numerical values and ranges of numerical values are expressions that not only have strict meanings but also include substantially equivalent ranges, such as those having margins of several percent.

Embodiment

[1. Operation of Organic EL Display Device]

An operation of an organic EL display device according to an embodiment will be described with reference to FIG.

17. Note that the organic EL display device according to this embodiment is characterized in the method of driving a pixel circuit, and the configuration of the pixel circuit may be the same as that of organic EL display device 1 according to the related art. In the following, it is assumed that the configuration of the organic EL display device according to this embodiment if the same as that of organic EL display device 1, and the description will be made using the reference numerals of organic EL display device 1.

For example, organic EL display device 1 according to this embodiment includes pixel circuits 20, horizontal selector 40 that supplies signal voltage Vsig to signal line 41, and a controller that performs a control to supply reference potential Vofs to gate electrode g of drive transistor T2. In this embodiment, the controller may include horizontal selector 40 and write scanner 60.

Furthermore, for example, pixel circuit 20 includes drive transistor T2 that supplies a current in accordance with signal voltage Vsig supplied through signal line 41, write transistor T1 connected between signal line 41 and gate electrode g of drive transistor T2, and organic EL element EL that emits light in accordance with the current.

Note that organic EL display device 1 is an example of the display device. In the following, an operation of pixel circuit 20 will be described which can reduce the difference in amount of variation ΔVs of source potential Vs between displays and can reduce amount of variation ΔVs itself.

Figure 17:
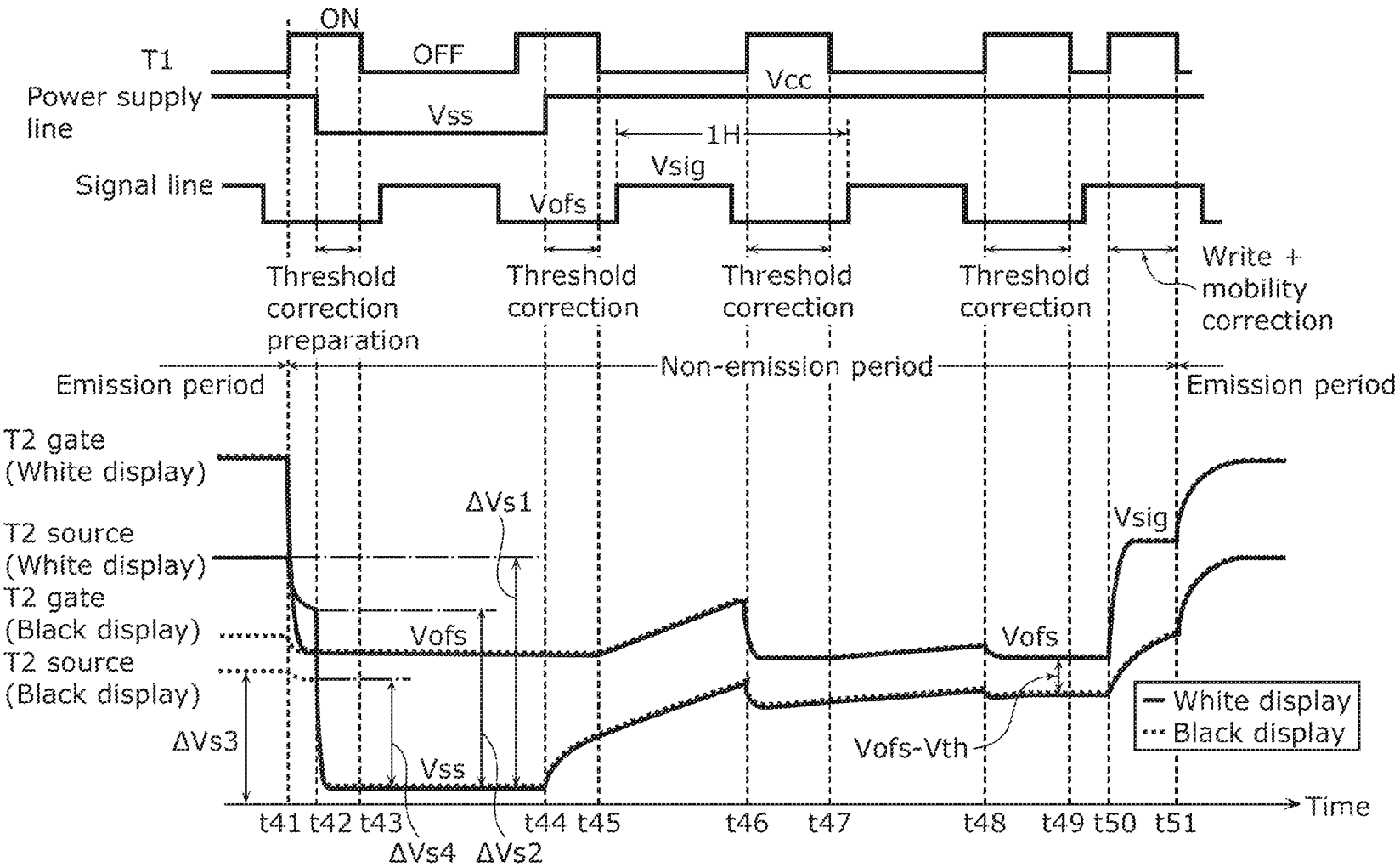
FIG. 17 is a timing chart for illustrating a circuit operation of an organic EL display device according to an embodiment.

FIG. 17 is a timing chart for illustrating a circuit operation of organic EL display device 1 according to this embodiment, and shows variations of a potential of a gate electrode of write transistor T1 (which is a potential of scan line 61 and is a high potential (ON) or a low potential (OFF)), a potential of power supply line 51 (first potential Vcc or second potential Vss), a potential of signal line 41 (signal voltage Vsig or reference potential Vofs), and potentials of gate electrode g of drive transistor T2 ("T2 GATE" in FIG. 17) and potentials of source electrode s of drive transistor ("T2 SOURCE" in FIG. 17) in cases of a white display and a black display. In addition, the potential of gate electrode g and the potential of source electrode s in the case of the white display are indicated by solid lines, and the potential of gate electrode g and the potential of source electrode s in the case of the black display are indicated by dashed lines. In this embodiment, first potential Vcc and second potential Vss are about 10V to 20V and about −5V to 0V, respectively, and reference potential Vofs is 0V.

Note that the circuit operation from time t43 to t51 illustrated in FIG. 17 is the same as the circuit operation from time t23 to t31 illustrated in FIG. 14 and therefore will not be further described.

As illustrated in FIG. 17, organic EL display device 1 according to this embodiment turns on write transistor T1 at time t41 before time t42 at which the potential of power supply line 51 varies from first potential Vcc to second potential Vss. That is, organic EL display device 1 supplies reference potential Vofs to gate electrode g of drive transistor T2 before the potential of power supply line 51 varies from first potential Vcc to second potential Vss in the non-emission period. It can also be said that organic EL display device 1 supplies reference potential Vofs to gate electrode g of drive transistor T2 before a threshold correction preparation operation of increasing gate-source voltage Vgs of drive transistor T2 to be higher than a threshold voltage of drive transistor T2. Reference potential Vofs is a voltage (reference voltage) higher than threshold voltage Vth of drive transistor T2, and is an example of a predetermined voltage. Reference potential Vofs may be a voltage for applying a forward bias between gate electrode g and source electrode s of drive transistor T2, for example. In this embodiment, reference potential Vofs is supplied from signal line 41 to gate electrode g of drive transistor T2 by turning on write transistor T1 before the threshold correction preparation operation.

Organic EL display device 1 changes the potential of power supply line 51 from first potential Vcc to second potential Vss when reference potential Vofs (fixed potential), rather than signal voltage Vsig depending on the display (a voltage depending on the video displayed), is being supplied to gate electrode g of drive transistor T2. It can also be said that reference potential Vofs is continuously supplied throughout the threshold correction preparation operation including the starting point of the threshold correction preparation operation. It can also be said that reference potential Vofs supplied to the gate electrode g of drive transistor T2 in the period from time t41 to t42 is a reset potential for resetting gate potential Vg.

In this way, the potential of power supply line 51 varies from first potential Vcc to second potential Vss in the state where reference potential Vofs is input to gate electrode g of drive transistor T2. That is, organic EL display device 1 can keep gate potential Vg of drive transistor T2 at the same potential (reference potential Vofs) regardless of whether the display is the white display or the black display when the potential of power supply line 51 varies from first potential Vcc to second potential Vss. For example, gate-source voltage Vgs of drive transistor T2 after the potential of power supply line 51 has varied to second potential Vss is reference potential Vofs minus second potential Vss, and is a constant value regardless of whether the display is the white display or the black display. For example, at time t42, gate potential Vg ("T2 GATE (WHITE DISPLAY") of drive transistor T2 in the case of the white display and gate potential Vg ("T2 GATE (BLACK DISPLAY") of drive transistor T2 in the case of the black display are approximately the same potential (such as reference potential Vofs), for example. Therefore, the difference in the amount of fluctuation of cathode potential Vcat due to the difference in display (whether the display is the white display or the black display) can be reduced, so that the difference in the amount of fluctuation of the anode potential of another line due to the difference in display can be reduced.

Furthermore, in the period from time t41 to t42, that is, in the period in which reference potential Vofs is supplied to the gate electrode g of drive transistor T2 and first potential Vcc is supplied to power supply line 51, source potential Vs of drive transistor T2 (anode potential of organic EL element EL) varies with the variation of gate potential Vg of drive transistor T2. In the period from time t41 to t42, if gate potential Vg decreases, source potential Vs also decreases.

For example, when the potential of power supply line 51 varies from first potential Vcc to second potential Vss in a state where gate potential Vg of drive transistor T2 is signal voltage Vsig (a case of the related art), the amount of variation of source potential Vs in the case of the white display is ΔVs1. On the other hand, in this embodiment, since source potential Vs decreases in the period from time t41 to t42, when the potential of power supply line 51 varies from first potential Vcc to second potential Vss, the amount of variation of source potential Vs in the case of the white display is ΔVs2 (<ΔVs1). Similarly, the amount of variation of source potential Vs in the case of the black display is ΔVs4 (<ΔVs3).

In this way, at time t42, amount of variation ΔVs of source potential Vs at the time when second potential Vss is applied to power supply line 51 can be reduced. As a result, the degree of the influence that the voltage variation of source potential Vs exerts on cathode potential Vcat through capacitive coupling (amount of coupling) can be reduced. That is, the amount of fluctuation of cathode potential Vcat can be reduced.

Therefore, organic EL display device 1 can reduce the influence on corrections for the other lines (other pixel rows) only by setting the timing to supply reference potential Vofs to gate electrode g of drive transistor T2 to be before the timing when power supply line 51 varies to second potential Vss, without modifying the configuration of pixel circuit 20, and therefore can display a video reduced in display unevenness, such as streaks.

Although a case where the potential of power supply line 51 varies from first potential Vcc to second potential Vss in the state where reference potential Vofs is applied to gate electrode g of drive transistor T2 has been described above with reference to FIG. 17, the present disclosure is not limited thereto. For example, after write transistor T1 is turned on at time t41 to supply reference potential Vofs to gate electrode g of drive transistor T2 as illustrated in FIG. 17, write transistor T1 may be turned off before time t42. That is, at time t42, reference potential Vofs need not be supplied to gate electrode g of drive transistor T2. Note that, from the viewpoint of ensuring that the anode of organic EL element EL is charged to second potential Vss, the potential of power supply line 51 can be changed from first potential Vcc to second potential Vss in the state where reference potential Vofs is applied to gate electrode g of drive transistor T2. For example, reference potential Vofs can be supplied to gate electrode g of drive transistor T2 throughout the threshold correction preparation operation including the starting point thereof.

[2. Effects and the Like]

As described above, a pixel circuit driving method according to the present embodiment is a method for driving pixel circuit 20 which includes: drive transistor T2 that supplies a current corresponding to signal voltage Vsig supplied via signal line 41; write transistor T1 connected between signal line 41 and gate electrode g of drive transistor T2; and organic EL element EL (an example of a light-emitting element) that emits light in accordance with the current. The pixel circuit driving method includes supplying reference potential Vofs (an example of a predetermined voltage) to gate electrode g of drive transistor T2 before a threshold correction preparation operation of making gate-source voltage Vgs of drive transistor T2 higher than threshold voltage Vth of drive transistor T2.

In this way, gate potential Vg of drive transistor T2 can be set at a constant value (such as reference potential Vofs) before the threshold correction preparation operation, regardless of the manner of display. For example, it is possible to reduce the difference in amount of variation ΔVs of source potential Vs of drive transistor T2 due to the difference in the manner of display at the time when the potential of power supply line 51 varies from first potential Vcc to second potential Vss to start the threshold correction preparation operation. That is, the streak display unevenness caused by the difference in amount of variation ΔVs of source potential Vs (see the conceptual diagram of the display in FIG. 16, for example) can be reduced. Therefore, the display quality of organic EL display device 1 is improved.

Furthermore, the predetermined voltage is supplied continuously throughout the threshold correction preparation operation including a starting point of the threshold correction preparation operation.

In this way, the anode of organic EL element EL can be prevented from failing to be charged to second potential Vss. For example, when the potential of power supply line 51 varies from first potential Vcc to second potential Vss after write transistor T1 is turned off before time t42 after write transistor T1 is turned on at time t41 as illustrated in FIG. 17, that is, in the state where reference potential Vofs is no longer continuously supplied to gate electrode g of drive transistor T2, gate potential Vg of drive transistor T2 deviates from reference potential Vofs as the anode potential of organic EL element EL varies.

In addition, since gate-source voltage Vgs of drive transistor T2 (gate potential Vg of drive transistor T2 minus second potential Vss) gradually decreases, there is a possibility that the anode of organic EL element EL cannot be charged to second potential Vss. On the other hand, when the potential of power supply line 51 varies from first potential Vcc to second potential Vss in the state where reference potential Vofs is applied to gate electrode g of drive transistor T2, gate potential Vg of drive transistor T2 is less likely to deviate from reference potential Vofs even if the anode potential of organic EL element EL varies. That is, since gate-source voltage Vgs of drive transistor T2 (gate potential Vg of drive transistor T2 minus second potential Vss) is less likely to gradually decrease, the anode of organic EL element EL can be charged to second potential Vss with higher reliability.

Furthermore, the predetermined voltage is a reference voltage, which is a higher voltage than threshold voltage Vth of drive transistor T2, for setting a forward bias across gate electrode g and source electrode s of drive transistor T2.

In this way, pixel circuit 20 that can reduce the display unevenness can be provided only by modifying the original timing of application of reference potential Vofs to gate electrode g of drive transistor T2 in the threshold correction preparation operation and the threshold correction operation, without adding a power supply for supplying reference potential Vofs or the like.

Furthermore, the supplying of the predetermined voltage includes supplying the predetermined voltage from signal line 41 to gate electrode g of drive transistor T2 by turning on write transistor T1 before the threshold correction preparation operation.

In this way, an arrangement for supplying reference potential Vofs to gate electrode g of drive transistor T2 need not be additionally provided, and a reset potential can be applied to gate electrode g through signal line 41. That is, pixel circuit 20 can be simplified. For example, the step of forming pixel circuit 20 in organic EL display device 1 can be simplified, and more inexpensive organic EL display device 1 can be produced in a shorter time.

Furthermore, the light-emitting element is organic EL element EL.

In this way, the display unevenness of organic EL display device 1 including organic EL elements EL can be reduced.

Pixel circuit 20 according to the present embodiment includes: drive transistor T2 that supplies a current corresponding to a signal voltage supplied via signal line 41; write transistor T1 connected between signal line 41 and gate electrode g of drive transistor T2; and organic EL element EL connected to one of source electrode s and drain electrode g of drive transistor T2. In addition, reference potential Vofs is applied to gate electrode g of drive transistor T2 before a threshold correction preparation operation of making gate-source voltage Vgs of drive transistor T2 higher than threshold voltage Vth of drive transistor T2. Furthermore, organic EL display device 1 according to the present embodiment includes: pixel circuit 20 described above; horizontal selector 40 that supplies signal voltage Vsig to signal line 41; and horizontal selector 40 and write scanner 60 (an example of a controller) that perform control for supplying reference potential Vofs to gate electrode g of drive transistor T2. In addition, horizontal selector 40 and write scanner 60 apply reference potential Vofs to gate electrode g of drive transistor T2 before the threshold correction preparation operation.

In this way, the same effects as those of the method of driving pixel circuit 20 described above can be achieved.

Variation 1 of Embodiment

Figure 18:
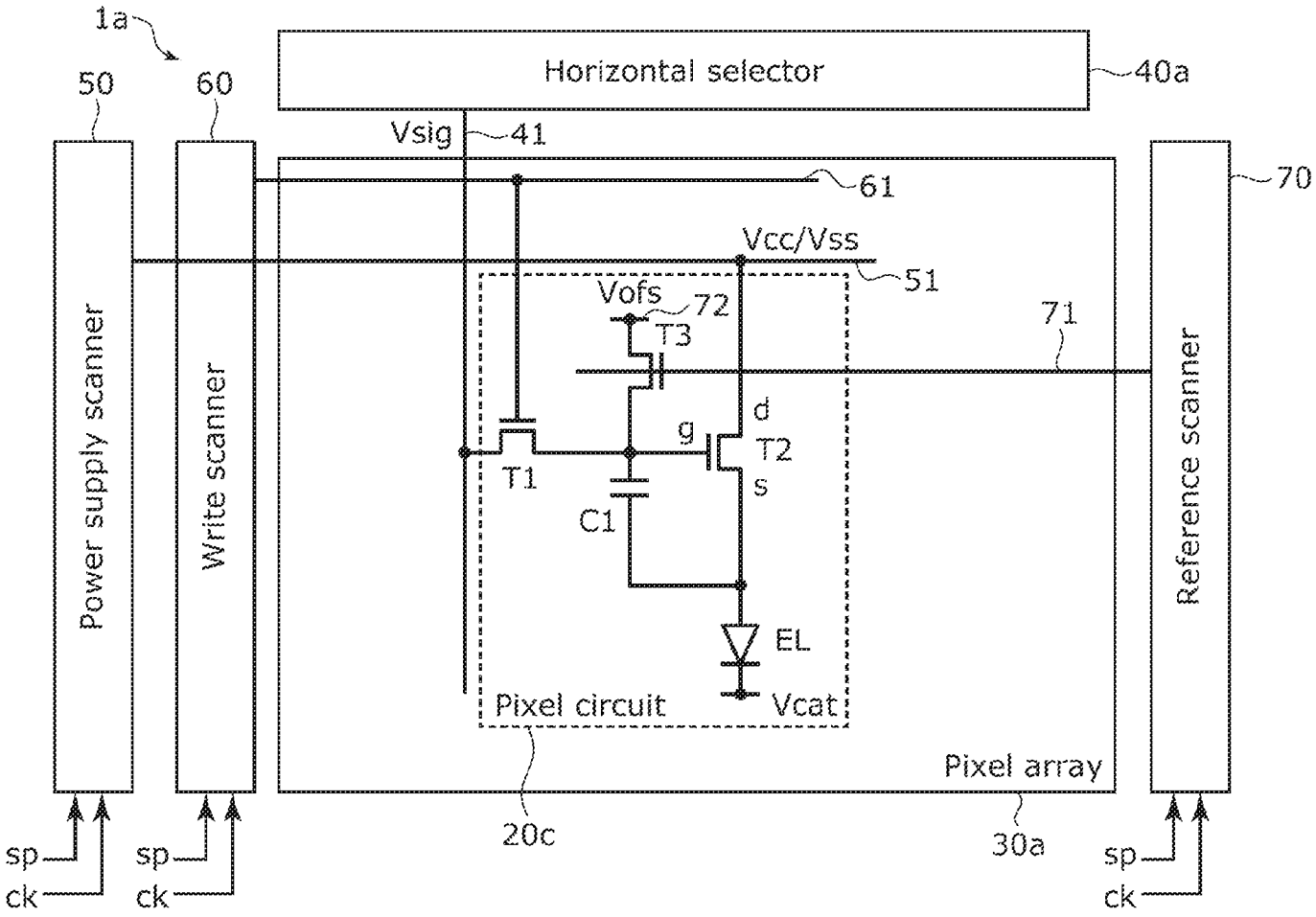
FIG. 18 is a diagram illustrating an outline configuration of an organic EL display device according to Variation 1 of the embodiment.

An outline configuration of organic EL display device 1*a* according to Variation 1 will be described with reference to FIG. 18. FIG. 18 is a diagram illustrating an outline configuration of organic EL display device 1*a* according to this variation. FIG. 18 illustrates a circuit diagram illustrating a circuit configuration of one pixel circuit 20*a* of a plurality of pixel circuits 20*a* in pixel array 30*a*. Organic EL display device 1*a* according to this variation differs from organic EL display device 1 according to the embodiment in that organic EL display device 1*a* is configured to be capable of supplying signal voltage Vsig and reference potential Vofs to drive transistor T2 through different transistors. In the following, pixel circuit 20*a* and organic EL display device 1*a* according to this variation will be described mainly with regard to the differences from pixel circuit 20 and organic EL display device 1 according to the embodiment. Components that are the same as or similar to those of pixel circuit 20 and organic EL display device 1 according to the embodiment will be denoted by the same reference numerals as those of pixel circuit 20 and organic EL display device 1, and descriptions thereof will be omitted or simplified.

As illustrated in FIG. 18, organic EL display device 1*a* according to this variation includes reference scanner 70 in addition to the components of organic EL display device 1 according to the embodiment, and has pixel array 30*a* and horizontal selector 40*a* instead of pixel array 30 and horizontal selector 40. Horizontal selector 40*a*, power supply scanner 50, write scanner 60, and reference scanner 70 form a driving circuit (driver) arranged in the periphery of pixel array 30*a*.

In pixel array 30*a* with m rows and n columns of pixels, power supply line 51, scan line 61, and control line 71 are arranged for each pixel row in a row direction (a direction of arrangement of pixel circuits 20*a* in a pixel row). In pixel array 30*a* with m rows and n columns of pixels, furthermore, signal line 41 is arranged for each pixel column in a column direction (a direction of arrangement of pixel circuits 20*a* in a pixel column).

Signal voltage Vsig output from horizontal selector 40*a* is written to each pixel circuit 20*a* in pixel array 30*a* through signal line 41 on a basis of a pixel row selected by scanning by write scanner 60. That is, horizontal selector 40*a* is driven in a line sequential write mode in which signal voltage Vsig is written on a row (line) basis. Note that, in this variation, reference potential Vofs is not output from horizontal selector 40*a*.

Reference scanner 70 is formed by a shift register circuit that sequentially shifts (transfers) start pulse sp in synchronization with clock pulse ck, for example. When switching each pixel circuit 20*a* in pixel array 30*a* from the emission period to the non-emission period, reference scanner 70 sequentially supplies a control signal to control line 71, thereby sequentially scanning pixel circuits 20*a* in pixel array 30*a* on a row basis (line sequential scanning). The control signal is a voltage for switching switching transistor T3 (SW transistor T3) illustrated in FIG. 18 between the conductive state and the non-conductive state. Each of a plurality of control lines 71 is connected to an output end of a corresponding pixel row of reference scanner 70.

Pixel circuit 20*a* has SW transistor T3 in addition to the components of pixel circuit 20 according to the embodiment. SW transistor T3 is connected between power supply line 72 to which reference potential Vofs is supplied and gate electrode g of drive transistor T2, and switches whether to apply reference potential Vofs to gate electrode g or not in accordance with the control signal from reference scanner 70. Power supply line 72 is connected to a power supply that can output reference potential Vofs, for example. SW transistor T3 is an example of a selection transistor.

As described above, pixel circuit 20*a* according to this variation is configured so that only signal voltage Vsig is supplied from signal line 41, and reference potential Vofs is supplied to gate electrode g of drive transistor T2 through SW transistor T3 additionally connected to gate electrode g.

Note that only one of write transistor T1 and SW transistor T3 is turned on. That is, write transistor T1 and SW transistor T3 are not turned on at the same time.

Figure 19:
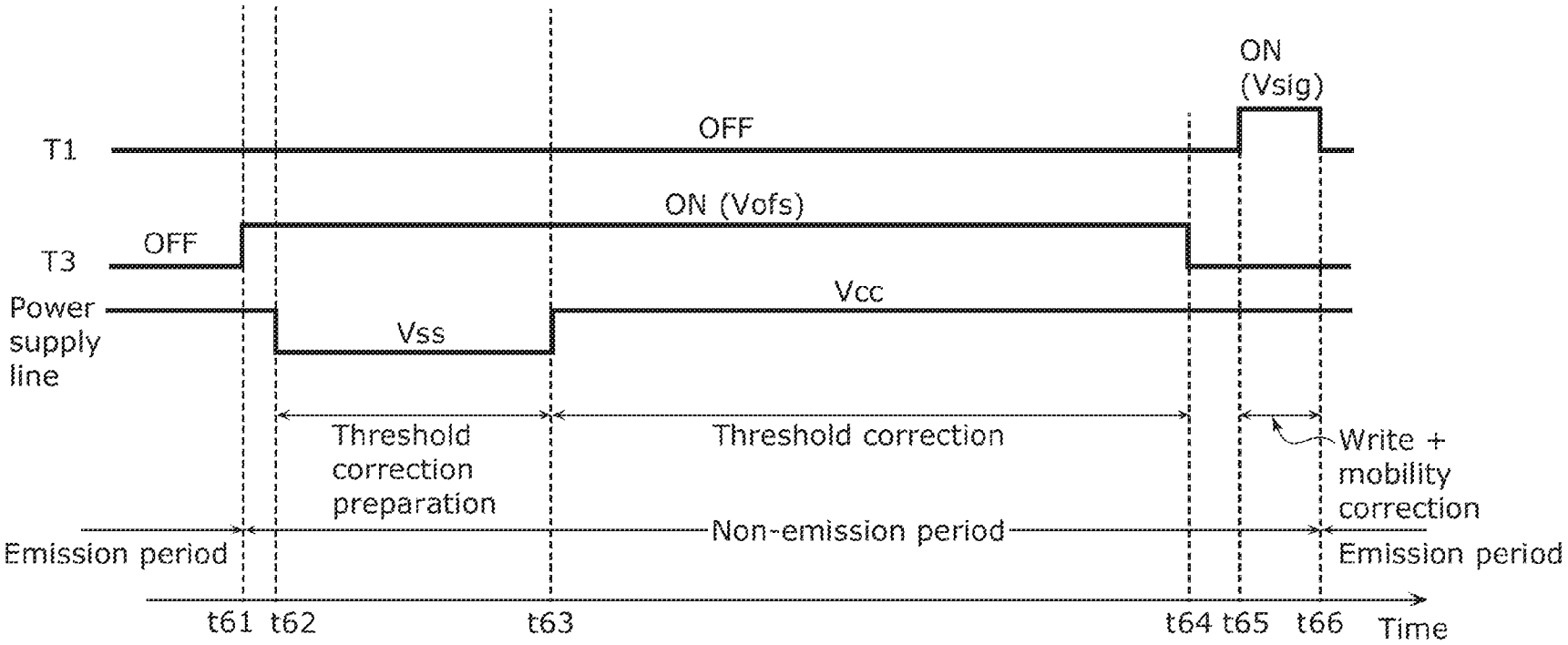
FIG. 19 is a timing chart for illustrating a circuit operation of an organic EL display device according to Variation 1 of the embodiment.

Next, an operation of organic EL display device 1*a* configured as described above will be described with reference to FIG. 19. FIG. 19 is a timing chart for illustrating a circuit operation of organic EL display device 1*a* according to this variation.

As illustrated in FIG. 19, at time t61, SW transistor T3 is turned on in response to a control signal from reference scanner 70. As a result, reference potential Vofs is supplied to gate electrode g of drive transistor T2 through power supply line 72 to turn off drive transistor T2, and as a result, organic EL display device 1*a* shifts from the emission period to the non-emission period. Note that, at time t61, first potential Vcc is being supplied to power supply line 51. Note that reference potential Vofs in this variation can be any potential that turns off drive transistor T2.

After that, at time t62, the potential of power supply line 51 varies from first potential Vcc to second potential Vss. As a result, the threshold correction preparation operation is started. Note that although, in the period from time t61 to t62, SW transistor T3 is kept on, the present disclosure is not limited thereto.

After that, at time t63, the potential of power supply line 51 varies from second potential Vss to first potential Vcc. As a result, the threshold correction operation is started.

After that, at time t64, SW transistor T3 is turned off in response to a control signal from reference scanner 70. As a result, the threshold correction operation ends.

After that, at time t65, write transistor T1 is turned on in response to a control signal from write scanner 60. As a result, signal voltage Vsig is supplied to gate electrode g of drive transistor T2, signal voltage Vsig is written into pixel circuit 20*a*, and the mobility correction is performed.

After that, at time t66, write transistor T1 is turned off in response to a control signal from write scanner 60, and as a result, the emission period starts. That is, organic EL element EL starts emitting light.

As described above, organic EL display device 1*a* according to this variation is the same as organic EL display device 1 according to the embodiment in that reference potential Vofs is applied to gate electrode g of drive transistor T2 before the potential of power supply line 51 varies from first potential Vcc to second potential Vss. It can also be said that reference potential Vofs is supplied to gate electrode g of drive transistor T2 from power supply line 72 by SW transistor T3 connected between gate electrode g of drive transistor T2 and power supply line 72 for supplying reference potential Vofs being turned on before the threshold correction preparation operation. Furthermore, with organic EL display device 1*a*, the potential of power supply line 51 can be changed from first potential Vcc to second potential Vss in the state where reference potential Vofs is applied to gate electrode g of drive transistor T2, for example.

As described above, in the method of driving pixel circuit 20*a* according to this variation, reference potential Vofs (an example of a predetermined voltage) is supplied to gate electrode g of drive transistor T2 from power supply line 72 by SW transistor T3 (an example of a selection transistor) connected between gate electrode g of drive transistor T2 and power supply line 72 for supplying reference potential Vofs being turned on before the threshold correction preparation operation.

In this way, even when pixel circuit 20*a* has SW transistor T3, reference potential Vofs can be supplied to gate electrode g of drive transistor T2 before the threshold correction preparation operation, and therefore, the display quality of a video displayed can be improved.

Variation 2 of Embodiment

Figure 20:
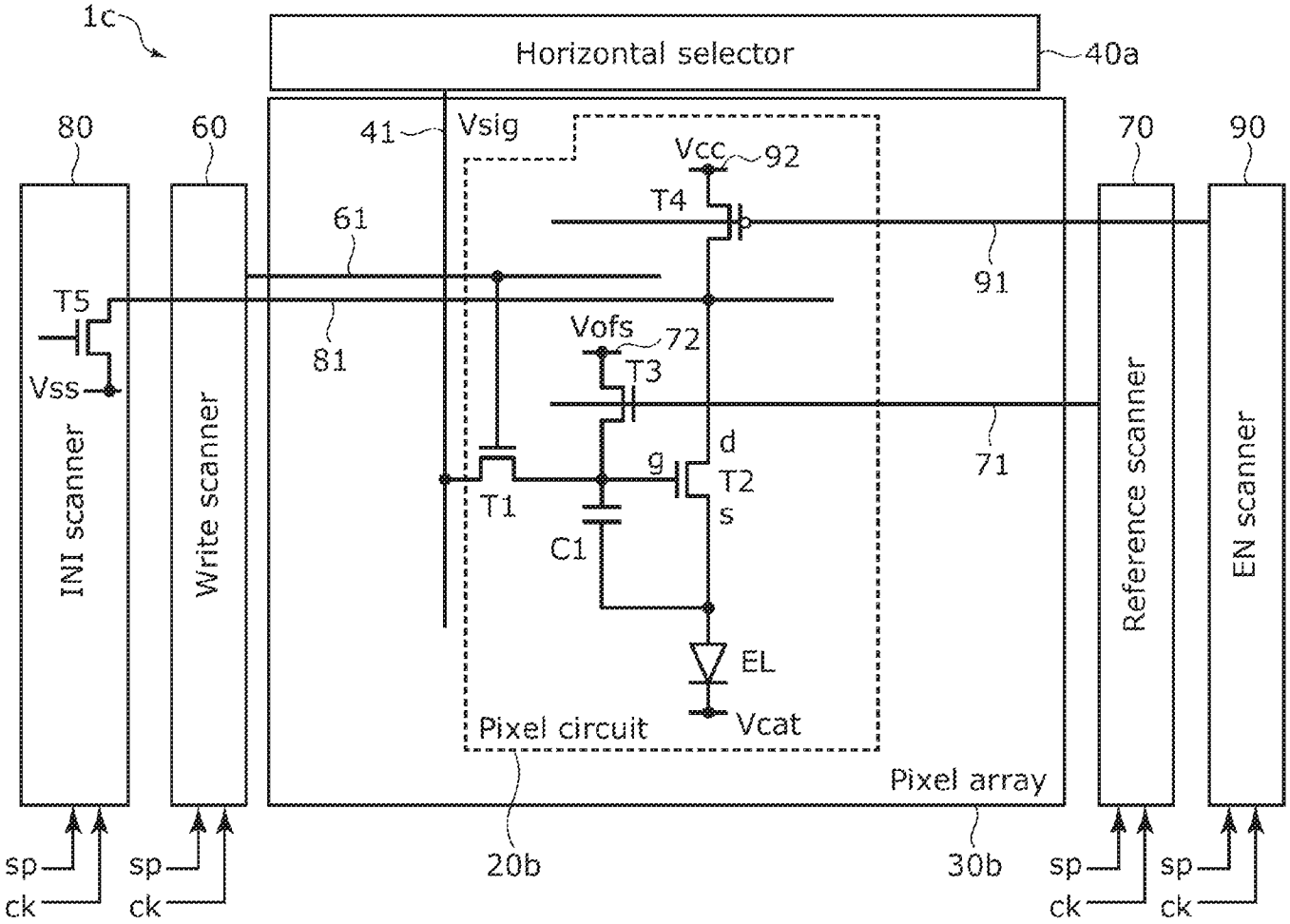
FIG. 20 is a diagram illustrating an outline configuration of an organic EL display device according to Variation 2 of the embodiment.

An outline configuration of organic EL display device 1*b* according to Variation 2 will be described with reference to FIG. 20. FIG. 20 is a diagram illustrating an outline configuration of organic EL display device 1*b* according to this variation. FIG. 20 illustrates a circuit diagram illustrating a circuit configuration of one pixel circuit 20*b* of a plurality of pixel circuits 20*b* in pixel array 30*b*. Organic EL display device 1*b* according to this variation differs from organic EL display device 1*a* according to Variation 1 of the embodiment in that INI scanner 80 (initialization scanner) and EN scanner 90 are used, power supply line 81 is scanned by INI scanner 80, and control line 91 is scanned by EN scanner 90, rather than scanning power supply line 51 by power supply scanner 50. In the following, pixel circuit 20*b* and organic EL display device 1*b* according to this variation will be described mainly with regard to the differences from pixel circuit 20*a* and organic EL display device 1*a* according to Variation 1 of the embodiment. Components that are the same as or similar to those of pixel circuit 20*a* and organic EL display device 1*a* according to Variation 1 of the embodiment will be denoted by the same reference numerals as those of pixel circuit 20*a* and organic EL display device 1*a*, and descriptions thereof will be omitted or simplified.

As illustrated in FIG. 20, organic EL display device 1*b* according to this variation includes INI scanner 80 and EN scanner 90 in addition to the components of organic EL display device 1*a* according to Variation 1 of the embodiment, and has pixel array 30*b* instead of pixel array 30*a*. Horizontal selector 40*a*, write scanner 60, reference scanner 70, INI scanner 80, and EN scanner 90 form a driving circuit (driver) arranged in the periphery of pixel array 30*b*.

In pixel array 30*b* with m rows and n columns of pixels, scan line 61, control lines 71 and 91, and power supply line 81 are arranged for each pixel row in a row direction (a direction of arrangement of pixel circuits 20*b* in a pixel row). In pixel array 30*b* with m rows and n columns of pixels, furthermore, signal line 41 is arranged for each pixel column in a column direction (a direction of arrangement of pixel circuits 20*b* in a pixel column).

INI scanner 80 is formed by a shift register circuit that sequentially shifts (transfers) start pulse sp in synchronization with clock pulse ck, for example. INI scanner 80 sequentially supplies second potential Vss to pixel circuits 20*b* in pixel array 30*b*, thereby sequentially scanning pixel circuits 20*b* on a row basis (line sequential scanning). INI scanner 80 outputs a voltage (control signal) for switching switching transistor T5 (SW transistor T5) provided in an output stage between the conductive state and the non-conductive state. The drain electrode of SW transistor T5 is connected to a power supply line to which second potential Vss is supplied. The power supply line is connected to a power supply that can supply second potential Vss, for example. In the electrode arrangement illustrated in FIG. 20, the source electrode of SW transistor T5 is connected to drain electrode d of drive transistor T2 via power supply line 81. Note that SW transistor T5 may be provided in pixel circuit 20*b*. Each of a plurality of power supply lines 81 is connected to an output end of a corresponding pixel row of INI scanner 80.

EN scanner 90 is formed by a shift register circuit that sequentially shifts (transfers) start pulse sp in synchronization with clock pulse ck, for example. EN scanner 90 sequentially supplies first potential Vcc to pixel circuits 20*b* in pixel array 30*b*, thereby sequentially scanning pixel circuits 20*b* on a row basis (line sequential scanning). EN scanner 90 outputs a voltage (control signal) for switching switching transistor T4 (SW transistor T4) provided in pixel circuit 20*b* between the conductive state and the non-conductive state. The source electrode of SW transistor T4 is connected to power supply line 92 to which first potential Vcc is supplied. Power supply line 92 is connected to a power supply that can supply first potential Vcc, for example. In the electrode arrangement illustrated in FIG. 20, the drain electrode of SW transistor T4 is connected to drain electrode d of drive transistor T2. Each of a plurality of control lines 91 is connected to an output end of a corresponding pixel row of EN scanner 90.

Pixel circuit 20*b* has SW transistor T4 in addition to the components of pixel circuit 20*a* according to Variation 1 of the embodiment. SW transistor T4 is connected between power supply line 92 for supplying first potential Vcc and drain electrode d of drive transistor T2, and switches whether to supply first potential Vcc to drain electrode d or not in accordance with the control signal from EN scanner 90. SW transistor T4 is a P-channel thin film transistor, for example, but is not limited thereto.

Note that SW transistors T4 and T5 are selectively turned on, for example. That is, SW transistors T4 and T5 are not turned on at the same time, for example.

As described above, with pixel circuit 20*b* according to this variation, the drain voltage of drain electrode d of drive transistor T2 is changed by turning on and off SW transistors T4 and T5. In this way, in pixel circuit 20*b*, power supply line 51 can be fixed at first potential Vcc.

Figure 21:
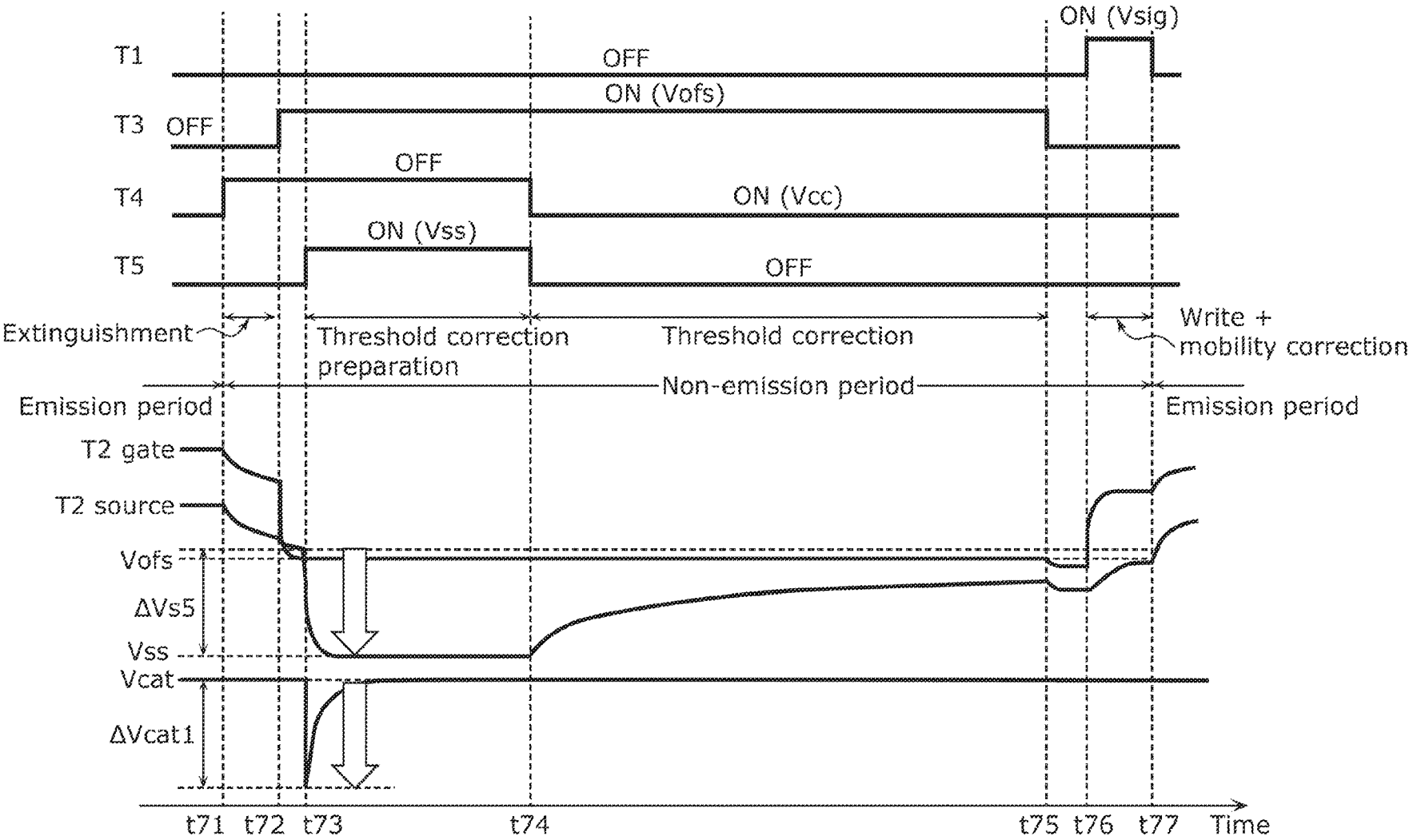
FIG. 21 is a timing chart for illustrating a circuit operation of an organic EL display device according to Variation 2 of the embodiment.

Next, an operation of organic EL display device 1*b* configured as described above will be described with reference to FIG. 21. FIG. 21 is a timing chart for illustrating a circuit operation of organic EL display device 1*b* according to this variation. Note that times t75 to t77 are the same as times t64 to t66 illustrated in FIG. 19 for Variation 1 of the embodiment, and will not be further described.

As illustrated in FIG. 21, at time t71, SW transistor T4 is turned off in response to a control signal from EN scanner 90. As a result, the supply of first potential Vcc to drain electrode d of drive transistor T2 is stopped, so that organic EL element EL is extinguished. That is, by turning off SW transistor T4, organic EL display device 1*b* shifts from the emission period to the non-emission period.

After that, at time t72, SW transistor T3 is turned on in response to a control signal from reference scanner 70. As a result, reference potential Vofs is supplied to gate electrode g of drive transistor T2 through power supply line 72 to turn off drive transistor T2. Note that, at time t72, SW transistor T5 is in the off state. That is, at time t72, second potential Vss is not being supplied to drain electrode d of drive transistor T2.

After that, at time t73, SW transistor T5 is turned on in response to a control signal from INI scanner 80. As a result, the threshold correction preparation operation is started. Time t73 corresponds to time t62 illustrated in FIG. 19. Note that although, at time t73, SW transistor T3 is kept on, for example, the present disclosure is not limited thereto.

After that, at time t74, SW transistor T5 is turned off in response to a control signal from INI scanner 80, and SW transistor T4 is turned on in response to a control signal from EN scanner 90. As a result, the threshold correction operation is started.

As described above, it can be said that, in pixel circuit 20*b*, the supply of the current to the other (drain electrode d, for example) of source electrode s and drain electrode d of drive transistor T2 is stopped before supplying reference potential Vofs to gate electrode g, and the supply of the voltage for reverse biasing organic EL element EL to the other electrode of drive transistor T2 is started after supplying reference potential Vofs to gate electrode g.

Note that, in the period from time t71 to t72, SW transistors T4 and T5 are in the off state, so that the current path to organic EL element EL via SW transistor T4 and the current path to organic EL element EL via SW transistor T5 are disconnected. In this way, since pixel circuit 20*b* has SW transistor T4, the current paths can be disconnected for a part of the period from the end of the emission period to the start of the threshold correction preparation period, so that the influence of the current flowing in that period on the display quality can be reduced. In this way, the display quality can be further improved. Furthermore, the potential of power supply line 92 can be fixed at first potential Vcc.

Figure 22:
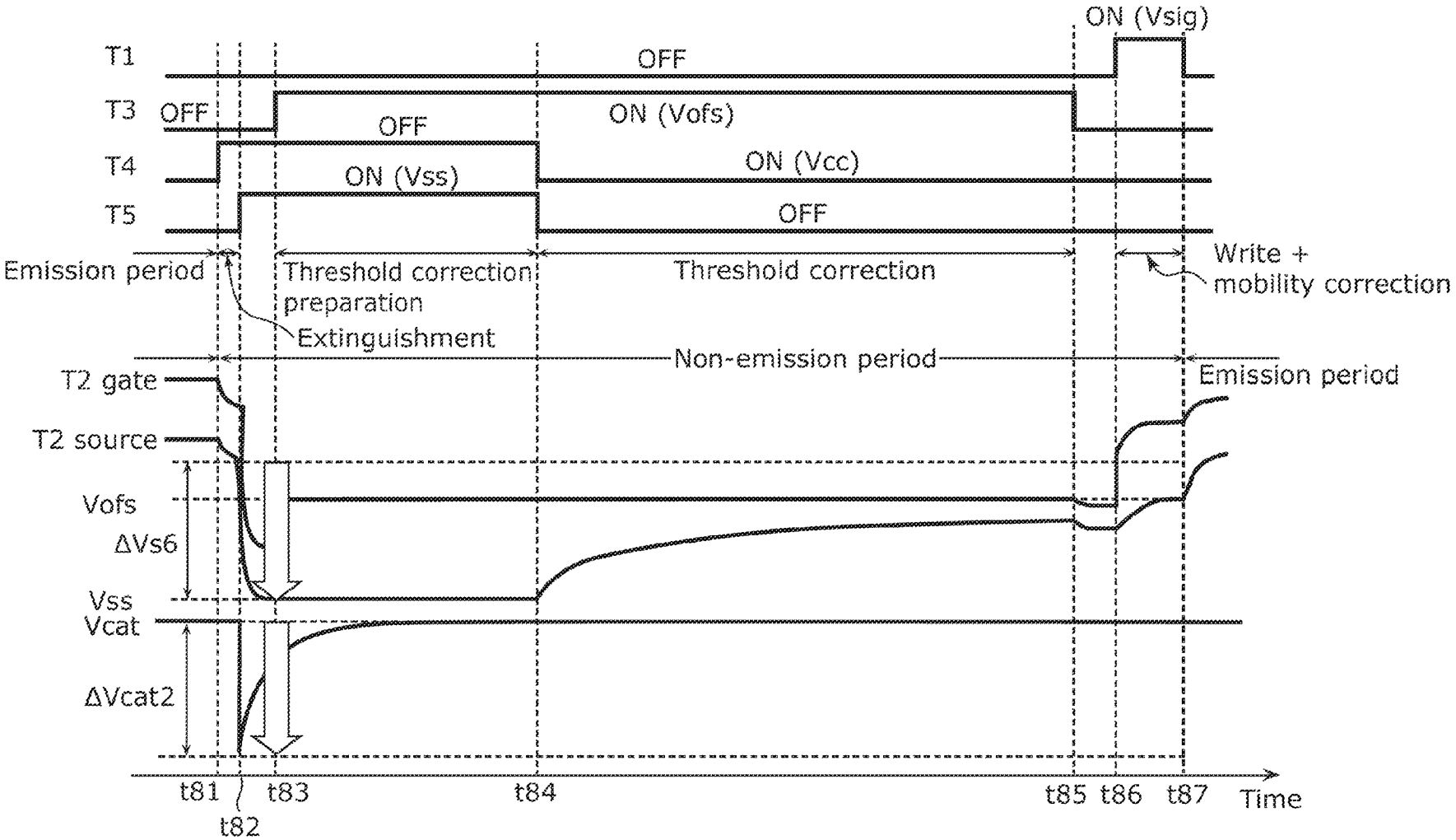
FIG. 22 is a timing chart for illustrating a circuit operation of an organic EL display device according to a comparison example.

Next, an operation of an organic EL display device according to a comparative example will be described with reference to FIG. 22. FIG. 22 is a timing chart for illustrating a circuit operation of the organic EL display device according to the comparative example. Note that the configuration of the organic EL display device according to the comparative example is the same as organic EL display device 1*b* according to this variation. Note that times t81, t84 to t87 are the same as times t71, and t74 to t77 illustrated in FIG. 21 for this variation, and will not be further described.

As illustrated in FIG. 22, at time t82, SW transistor T5 is turned on in response to a control signal from INI scanner 80. As a result, second potential Vss is supplied to drain electrode d of drive transistor T2. That is, second potential Vss is supplied to drain electrode d of drive transistor T2 before reference potential Vofs is supplied to gate electrode g of drive transistor T2.

After that, at time t83, SW transistor T3 is turned on in response to a control signal from reference scanner 70. As a result, reference potential Vofs is supplied to gate electrode of drive transistor T2 through power supply line 72, and the threshold correction preparation operation is started. At time t83, SW transistor T5 is in the on state. That is, second potential Vss is continuously supplied to drain electrode d of drive transistor T2 before and after time t83.

After that, at time t84, SW transistor T4 is turned on in response to a control signal from EN scanner 90, and SW transistor T5 is turned off in response to a control signal from INI scanner 80. As a result, the threshold correction operation is started.

Here, amounts of variation of source potential Vs and cathode potential Vcat in the operation of organic EL display device 1*b* according to this variation and the operation of the organic EL display device according to the comparative example will be described.

As illustrated in FIG. 21, in organic EL display device 1*b* according to this variation, since SW transistor T3 is turned on at time t72, gate potential Vg of drive transistor T2 further decreases from time t72 on, and source potential Vs of drive transistor T2 also further decreases from time t72 on. At time t73, the amount of variation of source potential Vs of drive transistor T2 at the time when SW transistor T5 is turned on is the difference between source potential Vs and second potential Vss at time t73 (amount of variation ΔVs5 illustrated in FIG. 21). In other words, at time t73, the amount of variation of source potential Vs of drive transistor T2 at the time when SW transistor T5 is turned on is smaller than the difference between source potential Vs and second potential Vss at time t72.

On the other hand, as illustrated in FIG. 22, in the organic EL display device according to the comparative example, at time t82, the amount of variation of source potential Vs of drive transistor T2 at the time when SW transistor T5 is turned on is the difference between source potential Vs and second potential Vss at time t82 (amount of variation ΔVs6 illustrated in FIG. 22). With the organic EL display device according to the comparative example, there is not a period corresponding to the period from t72 to t73 illustrated in FIG. 21, and therefore, the degree of the decrease of source potential Vs of drive transistor T2 is smaller than that of organic EL display device 1*b* according to this variation.

As described above, amount of variation ΔVs5 of source potential Vs of organic EL display device 1*b* according to this variation is smaller than amount of variation ΔVs6 of source potential Vs of the organic EL display device according to the comparative example. Therefore, amount of variation ΔVcat1 of cathode potential Vcat of organic EL display device 1*b* according to this variation is smaller than amount of variation ΔVcat2 of cathode potential Vcat of the organic EL display device according to the comparative example. That is, organic EL display device 1*b* according to this variation has a smaller amount of fluctuation of cathode potential Vcat than the organic EL display device according to the comparative example. Therefore, organic EL display device 1*b* according to this variation can reduce the deterioration of the display quality due to the fluctuation of cathode potential Vcat, compared with the organic EL display device according to the comparative example. Note that the same holds true for the organic EL display devices according to the embodiment described above and the other variations.

As described above, the organic EL element EL according to this variation is connected to one of source electrode s and drain electrode d of drive transistor T2. In the method of driving pixel circuit 20*b* according to this variation, the supply of the current to the other of source electrode s and drain electrode d of drive transistor T2 is stopped before supplying reference potential Vofs (an example of a predetermined voltage) to gate electrode g of drive transistor T2, and the supply of the voltage (such as second potential Vss) for reverse biasing organic EL element EL to the other electrode of drive transistor T2 is started after supplying reference potential Vofs to gate electrode g of drive transistor T2.

In this way, even when pixel circuit 20*b* has SW transistors T3 to T5, reference potential Vofs can be supplied to gate electrode g of drive transistor T2 before the threshold correction preparation operation, and therefore, the display quality of a video displayed can be improved. In addition, since the current paths to drive transistor T2 can be temporarily disconnected before the threshold correction preparation operation, the display quality of a video can be further improved.

Variation 3 of Embodiment

Figure 23:
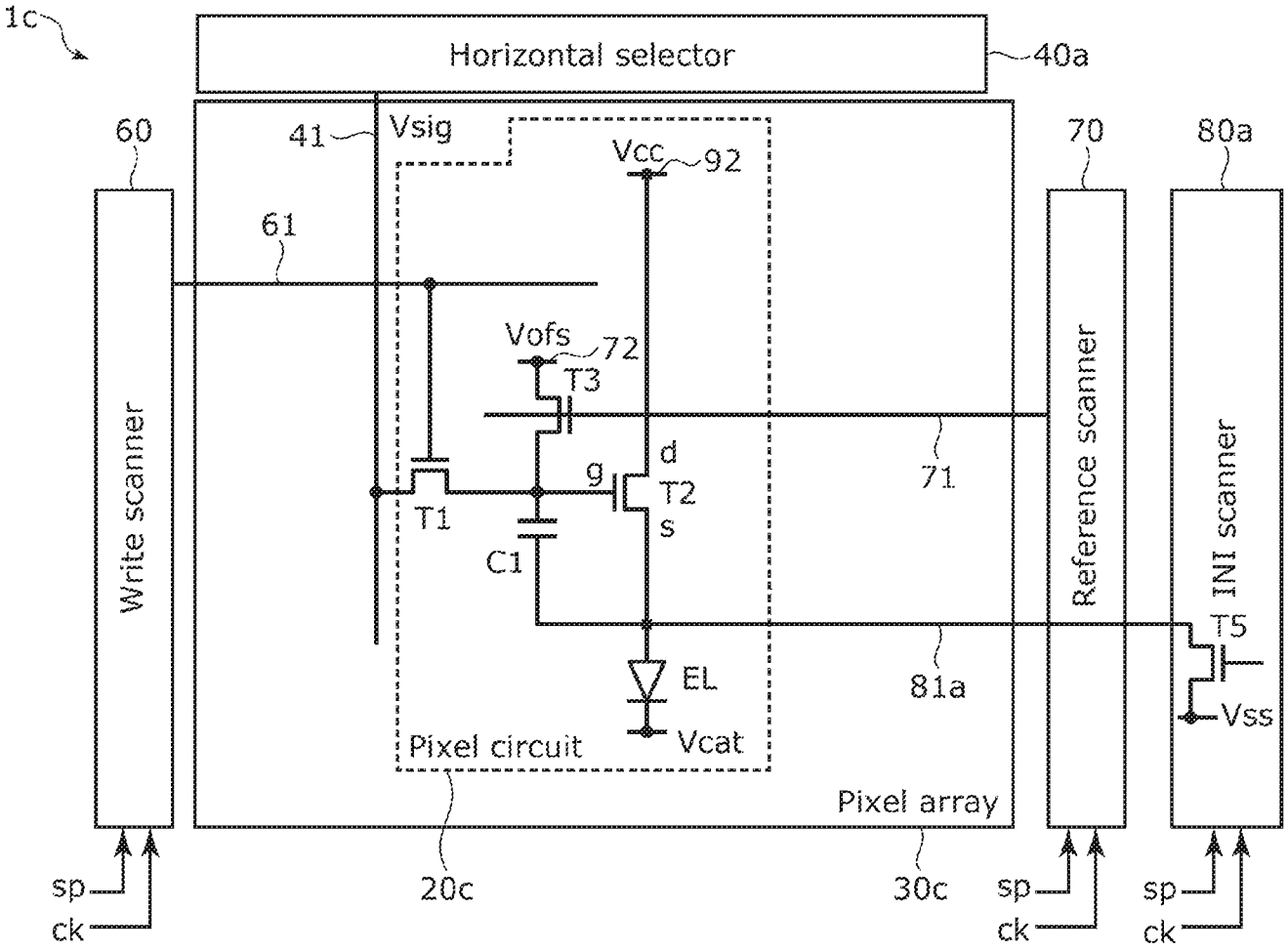
FIG. 23 is a timing chart for illustrating a circuit operation of an organic EL display device according to Variation 3 of the embodiment.

An outline configuration of organic EL display device 1*c* according to Variation 3 will be described with reference to FIG. 23. FIG. 23 is a diagram illustrating an outline configuration of organic EL display device 1*c* according to this variation. FIG. 23 illustrates a circuit diagram illustrating a circuit configuration of one pixel circuit 20*c* of a plurality of pixel circuits 20*c* in pixel array 30*c*. Organic EL display device 1*c* according to this variation differs from organic EL display device 1*b* according to Variation 2 of the embodiment in that second potential Vss is directly supplied to source electrode s of drive transistor T2. In the following, pixel circuit 20*c* and organic EL display device 1*c* according to this variation will be described mainly with regard to the differences from pixel circuit 20*b* and organic EL display device 1*b* according to Variation 2 of the embodiment. Components that are the same as or similar to those of pixel circuit 20*b* and organic EL display device 1*b* according to Variation 2 of the embodiment will be denoted by the same reference numerals as those of pixel circuit 20*b* and organic EL display device 1*b*, and descriptions thereof will be omitted or simplified.

As illustrated in FIG. 23, organic EL display device 1*c* differs from organic EL display device 1*b* in that organic EL display device 1*c* does not include EN scanner 90 and control line 91. In addition, organic EL display device 1*c* has pixel array 30*c*, instead of pixel array 30*b* of organic EL display device 1*b*. In addition, in organic EL display device 1*c*, power supply line 81*a* of INI scanner 80*a* is connected to source electrode s of drive transistor T2. Horizontal selector 40*a*, write scanner 60, reference scanner 70, and INI scanner 80*a* form a driving circuit (driver) arranged in the periphery of pixel array 30*c*.

In pixel array 30*c* with m rows and n columns of pixels, scan line 61, control line 71, and power supply line 81 are arranged for each pixel row in a row direction (a direction of arrangement of pixel circuits 20*c* in a pixel row). In pixel array 30*c* with m rows and n columns of pixels, furthermore, signal line 41 is arranged for each pixel column in a column direction (a direction of arrangement of pixel circuits 20*c* in a pixel column).

Pixel circuit 20*c* differs from pixel circuit 20*b* according to Variation 2 of the embodiment in that pixel circuit 20*c* does not have SW transistor T4. That is, drain electrode d of drive transistor T2 is connected to power supply line 92 without any transistor therebetween. First potential Vcc is supplied to power supply line 92.

INI scanner 80*a* is formed by a shift register circuit that sequentially shifts (transfers) start pulse sp in synchronization with clock pulse ck, for example. INI scanner 80*a* sequentially supplies second potential Vss to source electrode s of drive transistors T2 of pixel circuits 20*c* in pixel array 30*c*, thereby sequentially scanning pixel circuits 20*c* on a row basis (line sequential scanning). INI scanner 80*a* outputs a voltage (control signal) for switching SW transistor T5 provided in an output stage between the conductive state and the non-conductive state. The drain electrode of SW transistor T5 is connected to a power supply line to which second potential Vss is supplied. The power supply line is connected to a power supply that can supply second potential Vss, for example. In the electrode arrangement illustrated in FIG. 23, the source electrode of SW transistor T5 is connected to drain electrode d of drive transistor T2 via power supply line 81*a*. Note that SW transistor T5 may be provided in pixel circuit 20*c*.

As described above, pixel circuit 20*c* according to this variation is configured so that source potential Vs of drive transistor T2 is directly changed by turning on and off SW transistor T5.

Figure 24:
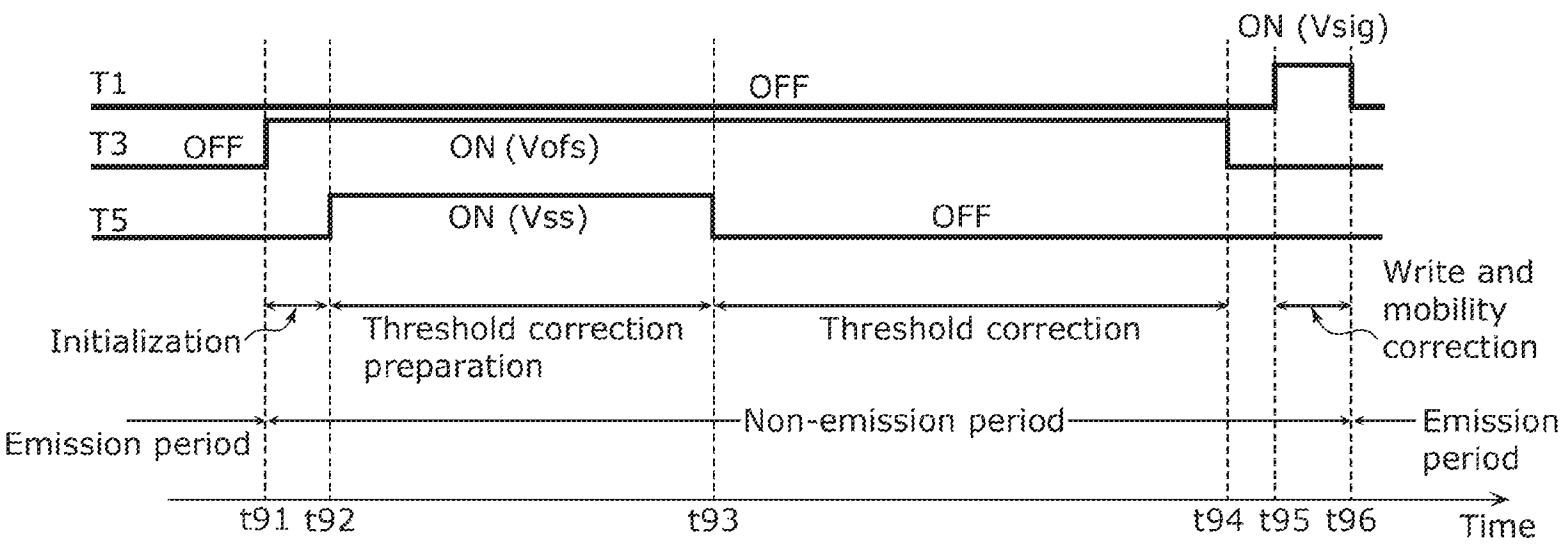
FIG. 24 is a timing chart for illustrating a circuit operation of an organic EL display device according to Variation 3 of the embodiment.

Next, an operation of organic EL display device 1*c* configured as described above will be described with reference to FIG. 24. FIG. 24 is a timing chart for illustrating a circuit operation of organic EL display device 1*c* according to this variation. Note that times t94 to t96 are the same as times t75 to t77 illustrated in FIG. 21 for Variation 2 of the embodiment, and will not be further described.

As illustrated in FIG. 24, at time t91, SW transistor T3 is turned on in response to a control signal from reference scanner 70. As a result, reference potential Vofs is applied to gate electrode g of drive transistor T2 via power supply line 72 to turn off drive transistor T2, so that organic EL display device 1*c* shifts from the emission period to the non-emission period. Note that, at time t91, SW transistor T5 is in the off state. That is, second potential Vss is not being applied to source electrode s of drive transistor T2.

After that, at time t92, SW transistor T5 is turned on in response to a control signal from INI scanner 80*a*. As a result, the threshold correction preparation operation is started. Note that, at time t92, SW transistor T3 is kept on, but the present disclosure is not limited thereto.

After that, at time t93, SW transistor T5 is turned off in response to a control signal from INI scanner 80*a*. As a result, the threshold correction operation is started.

As described above, with organic EL display device 1*c*, reference potential Vofs is applied to gate electrode g of drive transistor T2 before second potential Vss is applied to source electrode s of drive transistor T2. That is, SW transistor T3 is turned on before SW transistor T5 is turned on. With organic EL display device 1*c*, a voltage (such as second potential Vss) for reverse biasing organic EL element EL is supplied to the anode electrode of organic EL element EL after reference potential Vofs is supplied to gate electrode g of drive transistor T2. As a result, as in the embodiment and the variations described above, the display unevenness can be reduced.

As described above, organic EL element EL according to this variation is connected to one of source electrode s and drain electrode d of drive transistor T2. In the method of driving pixel circuit 20*c* according to this variation, a voltage (such as second potential Vss) for reverse biasing organic EL element EL is supplied to the anode electrode of organic EL element EL after reference potential Vofs (an example of a predetermined voltage) is supplied to gate electrode g of drive transistor T2.

In this way, even when pixel circuit 20*c* has SW transistors T3 and T4, reference potential Vofs can be supplied to gate electrode g of drive transistor T2 before the threshold correction preparation operation, and therefore, the display quality of a video displayed can be improved.

Other Embodiments

Although a method of driving a pixel circuit according to the present disclosure and the like have been described based on an embodiment and variations thereof (referred to also as an embodiment and the like, hereinafter), the method of driving a pixel circuit according to the present disclosure and the like is not limited to the embodiment and the like described above. The present disclosure includes another embodiment implemented by a combination of any components of the embodiment and the like, a variation obtained by making, to the embodiment and the like, various modifications that occur to those skilled in the art without departing from the spirit of the present disclosure, various kinds of equipment in which the method of driving a pixel circuit according to the present disclosure and the like is implemented, or various kinds of equipment incorporating the pixel circuit or organic EL display device according to the present disclosure.

For example, although the embodiment and the like has been described above with regard to an example in which the light emitting element of the organic EL display device is organic EL element EL, the present disclosure is not limited thereto. The light emitting element may be another self-emitting light emitting element. For example, the light emitting element may be a light emitting element that uses a quantum-dot light emitting diode (QLED).

Furthermore, although the embodiment and the like has been described above with regard to an example in which the predetermined voltage supplied to gate electrode g of drive transistor T2 is reference potential Vofs, the predetermined voltage is not limited to reference potential Vofs. Regardless of the display or pixel location, the predetermined potential may be a potential other than reference potential Vofs, as far as a constant potential is applied to gate electrode g of drive transistor T2. The predetermined potential may be a potential common to frames, for example.

Furthermore, generic and specific aspects of the present disclosure may be implemented as a system, a method, an integrated circuit, a computer program, or a computer-readable recording medium such as a CD-ROM. Furthermore, the generic and specific aspects of the present disclosure may be may be implemented as any combination of a system, a method, an integrated circuit, a computer program, and a recording medium.

INDUSTRIAL APPLICABILITY

The present disclosure is advantageous for a pixel circuit using an organic EL element, for example.

The invention claimed is:

1. A method for driving a pixel circuit including a drive transistor that supplies a current corresponding to a signal voltage supplied via a signal line, a write transistor connected between the signal line and a gate electrode of the drive transistor, and a light-emitting element that emits light in accordance with the current, the method comprising:

supplying a predetermined voltage to the gate electrode of the drive transistor before a threshold correction preparation operation of making a gate-source voltage of the drive transistor higher than a threshold voltage of the drive transistor, wherein the write transistor is connected directly to the signal line and to the gate electrode of the drive transistor, and the predetermined voltage is supplied from the signal line to the gate electrode of the drive transistor by turning ON the write transistor.

2. The method according to claim 1, wherein the predetermined voltage is supplied continuously throughout the threshold correction preparation operation including a starting point of the threshold correction preparation operation.

3. The method according to claim 1, wherein the predetermined voltage is a reference voltage for setting a forward bias across the gate electrode and a source electrode of the drive transistor, the reference voltage being a higher voltage than the threshold voltage of the drive transistor.

4. The method according to claim 1, wherein the supplying of the predetermined voltage includes:

supplying the predetermined voltage from the signal line to the gate electrode of the drive transistor by turning on the write transistor before the threshold correction preparation operation.

5. The method according to claim 1, wherein the supplying of the predetermined voltage includes:

supplying the predetermined voltage from a power supply line to the gate electrode of the drive transistor by turning on a selection transistor connected between the gate electrode of the drive transistor and the power supply line before the threshold correction preparation operation, the power supply line being a line for supplying the predetermined voltage.

6. The method according to claim 1, wherein the light-emitting element is connected to one of a source electrode and a drain electrode of the drive transistor, the method further comprising:

supplying a voltage for setting the light-emitting element to a reverse bias to an anode electrode of the light-emitting element, after the predetermined voltage is supplied to the gate electrode of the drive transistor.

7. The method according to claim 1, wherein the light-emitting element is connected to one of a source electrode and a drain electrode of the drive transistor, the method further comprising:

stopping supply of the current to an other of the source electrode and the drain electrode of the drive transistor before supplying the predetermined voltage to the gate electrode of the drive transistor; and starting supply of a voltage for setting the light-emitting element to a reverse bias to the other of the source electrode and the drain electrode of the drive transistor, after supplying the predetermined voltage to the gate electrode of the drive transistor.

8. The method according to claim 1, wherein the light-emitting element is an organic electroluminescent (EL) element.

9. The method according to claim 1, wherein the predetermined voltage is supplied to the gate electrode of the drive transistor during a period immediately preceding the threshold correction preparation operation of making the gate-source voltage of the drive transistor higher than the threshold voltage of the drive transistor.

10. The method according to claim 9, wherein the predetermined voltage is further supplied to the gate electrode of the drive transistor continuously throughout the threshold correction preparation operation of making the gate-source voltage of the drive transistor higher than the threshold voltage of the drive transistor.

11. The method according to claim 1, wherein the predetermined voltage supplied to the gate electrode of the drive transistor is a reset potential for resetting a gate potential of the gate electrode of the drive transistor.

12. A pixel circuit, comprising:

a drive transistor that supplies a current corresponding to a signal voltage supplied via a signal line;

a write transistor connected between the signal line and a gate electrode of the drive transistor; and a light-emitting element connected to one of a source electrode and a drain electrode of the drive transistor, wherein a predetermined voltage is applied to the gate electrode of the drive transistor before a threshold correction preparation operation of making a gate-source voltage of the drive transistor higher than a threshold voltage of the drive transistor, wherein the write transistor is connected directly to the signal line and to the gate electrode of the drive transistor, and the predetermined voltage is supplied from the signal line to the gate electrode of the drive transistor by turning ON the write transistor.

13. A display device, comprising:

the pixel circuit according to claim 12;

a signal line driving circuit that supplies a signal voltage to the signal line; and a write scanning circuit that performs control for supplying the predetermined voltage to the gate electrode of the drive transistor, wherein the write scanning circuit applies the predetermined voltage to the gate electrode of the drive transistor before the threshold correction preparation operation.

14. The pixel circuit according to claim 12, wherein the write transistor is turned ON and the predetermined voltage is supplied to the gate electrode of the drive transistor during a period immediately preceding the threshold correction preparation operation of making the gate-source voltage of the drive transistor higher than the threshold voltage of the drive transistor.

15. The pixel circuit according to claim 14, wherein the write transistor is turned ON and the predetermined voltage is further supplied to the gate electrode of the drive transistor continuously throughout the threshold correction preparation operation of making the gate-source voltage of the drive transistor higher than the threshold voltage of the drive transistor.

* * * * *